US005663517A

United States Patent [19]

Oppenheim

[11] Patent Number: 5,663,517

[45] Date of Patent: Sep. 2, 1997

[54] INTERACTIVE SYSTEM FOR COMPOSITIONAL MORPHING OF MUSIC IN REAL-TIME

[75] Inventor: Daniel Vincent Oppenheim, Croton on Hudson, N.Y.

[73] Assignee: International Business Machines Corporation, Armonk, N.Y.

[21] Appl. No.: 522,636

[22] Filed: Sep. 1, 1995

[51] Int. Cl.[6] ..... A63H 5/00; G10H 1/26; G10H 5/00

[52] U.S. Cl. ..... 84/649; 84/651

[58] Field of Search ..... 84/609, 611, 635, 84/649, 651

[56] References Cited

U.S. PATENT DOCUMENTS 5,331,112 7/1994 Sato et al. ..... 84/609

5,495,073 2/1996 Fujishima et al. ..... 84/609

*Primary Examiner*—Jonathan Wysocki

*Assistant Examiner*—Jeffrey W. Donels

*Attorney, Agent, or Firm*—Stephen C. Kaufman

[57] ABSTRACT

A system suitable for effecting musical morphing in real time. The system comprises a computer comprising a programmable memory for storing a program. The program comprises the steps of selecting a first musical sequence of events; and identifying a family of first musical elements encompassed by said first musical sequence; selecting a second musical sequence of events; identifying a family of second musical elements encompassed by said second musical sequence. For each new event that is to be generated, the program comprises creating at least one paired set comprising one element from each of the first and second musical sequences; associating each paired set to a parameter type in the new event. For each element of the paired sets the program comprises assigning a grouping function for selecting values from the musical elements; assigning a morphing factor for determining a relative weight of resemblance to each of said musical sequences; and assigning a transformation function for mapping the selected values in accordance with a morphing factor for that set, thereby generating a value comprising one parameter of the new event. The system further includes a means for converting the new event into a control signal and a synthesizer for inputting the control signal and outputting a sound signal.

24 Claims, 25 Drawing Sheets

MORPHING IN A 2 OR 3D SPACE

| | TRANSFORMATION | BACH | SCALE |
|---|---|---|---|
| ONSET (RHYTHM) | SELECTION | ON | ON |
| PITCH | SELECTION | ON | OFF |
| DURATION | SELECTION | ON | ON |
| GROUPING | WARPED | | |

48

| | TRANSFORMATION | BACH | SCALE |
|---|---|---|---|
| ONSET (RHYTHM) | INTERPOLATION | ON | ON |
| PITCH | SELECTION | ON | OFF |
| DURATION | SELECTION | ON | ON |
| GROUPING | WARPED | | |

50

| | TRANSFORMATION | BACH | SCALE |
|---|---|---|---|
| ONSET (RHYTHM) | SELECTION | ON | ON |
| PITCH | SELECTION | ON | OFF |
| DURATION | SELECTION | ON | ON |
| GROUPING | SYNC | | |

52

| | TRANSFORMATION | BACH | SCALE |
|---|---|---|---|
| ONSET (RHYTHM) | INTERPOLATION | ON | ON |
| PITCH | SELECTION | ON | OFF |
| DURATION | SELECTION | ON | ON |
| GROUPING | SYNC | | |

54

| | TRANSFORMATION | BACH | SCALE |
|---|---|---|---|
| ONSET (RHYTHM) | SELECTION | ON | ON |
| PITCH | SELECTION | OFF | ON |
| DURATION | SELECTION | ON | ON |
| GROUPING | WARP | | |

56

| | TRANSFORMATION | BACH | SCALE |
|---|---|---|---|
| ONSET (RHYTHM) | INTERPOLATION | ON | ON |
| PITCH | SELECTION | OFF | ON |
| DURATION | SELECTION | ON | OFF |
| GROUPING | WARP | | |

58

| | TRANSFORMATION | BACH | SCALE |
|---|---|---|---|
| ONSET (RHYTHM) | SELECTION | ON | ON |
| PITCH | SELECTION | OFF | ON |
| DURATION | SELECTION | ON | OFF |
| GROUPING | SYNC | | |

60

| | TRANSFORMATION | BACH | SCALE |
|---|---|---|---|
| ONSET (RHYTHM) | SELECTION | ON | ON |
| PITCH | SELECTION | OFF | ON |
| DURATION | SELECTION | ON | OFF |
| GROUPING | SYNC | | |

62

| | TRANSFORMATION | BACH | SCALE |
|---|---|---|---|
| ONSET (RHYTHM) | SELECTION | ON | ON |
| PITCH | SELECTION | ON | ON |
| DURATION | SELECTION | ON | ON |
| GROUPING | SYNC | | |

64

| | TRANSFORMATION | BACH | MOZART |
|---|---|---|---|
| ONSET (RHYTHM) | SELECTION | ON | ON |
| PITCH | SELECTION | ON | ON |
| DURATION | SELECTION | ON | ON |
| GROUPING | SYNC | | |

72

INTERACTIVE SYSTEM FOR COMPOSITIONAL MORPHING OF MUSIC IN REAL-TIME

FIELD OF THE INVENTION

This invention relates to a novel method and system for effecting musical morphing in real time.

INTRODUCTION TO THE INVENTION

The idea of a process that gradually transforms a well defined initial state into a new one—a goal or resolution—is one of the most fundamental aesthetic ideals in Western art, be it music, literature, theater, dance, or film. In music, it forms the underlying concept of what we broadly term Tonality, and has been employed in most all Western music from the late Renaissance to the present. This ideal was already defined by Aristotle, who claimed that a 'good' tragedy must have a clear beginning, middle, and end; indeed, the hero in Greek tragedies undergoes a transformation that climaxes when he finally comes to terms with his inevitable fate—the catharsis.

Music theorists refer to this process as a movement towards 'the point of arrival', a sensation that is perceived due to an interplay between tension and relief. Many compositional techniques can be used to craft music in which a listener may perceive such a sensation; the two most formalized are Functional Harmony and Thematic Development. In functional harmony, tension may be created by moving away from the tonic into subdominant and dominant areas, and is resolved only by the final return to the tonic. This is such a powerful system that it is often used synonymously with the broader term Tonality. Indeed, in Baroque music functional harmony is the principle driving engine for tonality, and often a single motif is constantly repeated as it is spun out over an harmonic framework.

Classical composers expanded their palette and began to experiment composing music with several contrasting themes—an experiment that gave birth to the Classical Sonata. They were then faced with a new problem of unification: are the contrasting themes merely an arbitrary collection, or does each uniquely belong to a whole through some overall unifying scheme? Whereas harmony served as a framework that organized structure and provided a placeholder for each theme, it could not justify why a certain theme could not be replaced by hundreds of others. This is where the techniques of Thematic Development began to play an important role. Various themes would often share thematic elements that were worked out differently in each, yet still recognizable by an alert listener (for example, in Beethoven's sonata op. 31 no. 1 pitch and rhythmic motifs are interchanged in the first and second theme.) This idea was extended by composers such as Haydn and Beethoven, who focused not only on the themes and the thematic relationships between them, but also more and more on the musical sections that connect them: the bridge and development. Often these sections initiate a process in which musical elements from the previous theme are gradually placed into the background as elements from the next theme are slowly introduced and become prominent (for example: Haydn Sonata Hob XVI:24 in D major, measures 84–100; Hob XVI:49 in E flat major, adagio measures 57–80; Finale measures 68–87). This produces the sensation of a natural transformation from one theme into another. We use the modern term Morph to refer to this thematic process.

The notion of morphing gradually became commonplace in compositional thinking. It has been used more frequently as composers sought alternatives to functional harmony, as can be seen in numerous examples: the opening to Beethoven's IX symphony is a transition from chaos into order. The second movement of Berlioz's Harold in Italy gradually morphs from the Harold theme into the procession theme, as a procession is portrayed moving towards, and then away from, the listener. Ravel, in La Valse gradually morphs from chaos into a Viennese waltz, and then back to chaos. In modern music the concept of morphing was broadened and applied to entire sonic environments; the first movement of Pendercki's second string quartet is a morph from non-pitched, short, noise-like percussive material into sustained notes with a definite pitch. In electronic music and Musique Concréte, morphing became a widespread technique for modulating one sonic-texture into another. This can be found in numerous works by composers such as Francoise Bayle and Guy Reibel. Nowadays, computers offer an ideal environment for such exploration. Typically composers would write dedicated programs for realizing a Morph within a specific composition, such as in Paul Lansky's Quakerbridge, Kaja Saariaho's IO, and Larry Polansky's Bedhaya Sadra/Bedhyaya Guthrie for choir, kemanak, gamelan and melody instruments or 51 Melodies for two electric guitars and rock band.

SUMMARY OF THE INVENTION

In this invention we disclosé DMorph: a novel interactive method and system for compositional morphing of music in real time. We begin by explaining what morphing is, how it can be realized in a computer, then describe the DMorph system, its implementation and user interface, and discuss its possible application for music, and in conjunction with other media.

The invention in a first aspect comprises a method for effecting musical morphing in real time, the method comprising the steps of:

1) selecting a first sequence of musical events;
2) identifying a family of first musical elements encompassed by said first musical sequence;
3) selecting a second sequence of musical events;
4) identifying a family of second musical elements encompassed by said second musical sequence;

for each new event that is to be generated 5) creating at least one paired set comprising one musical element from each of the first and second sequences;
6) associating each paired set to a parameter type in the new event;

and for each element of the paired sets 7) assigning a grouping function for selecting values from the musical elements;
8) assigning a morphing factor for determining a relative weight of resemblance to each of said musical sequences;

and 9) assigning a transformation function for mapping the selected values in accordance with a morphing factor for that set, thereby generating a value comprising one parameter of the new event.

The invention in a second aspect comprises a system suitable for effecting musical morphing in real time, the system comprising:

1) a computer comprising a programmable memory for storing a program comprising the steps of:
   i) selecting a first musical sequence of events;
   ii) identifying a family of first musical elements encompassed by said first musical sequence;

iii) selecting a second musical sequence of events;

iv) identifying a family of second musical elements encompassed by said second musical sequence;

for each new event that is to be generated v) creating at least one paired set comprising one element from each of the first and second musical sequences;

vi) associating each paired set to a parameter type the new event;

and for each element of the paired sets vii) assigning a grouping function for selecting values from the musical elements;

viii) assigning a morphing factor for determining a relative weight of resemblance to each of said musical sequences;

and ix) assigning a transformation function for mapping the selected values in accordance with a morphing factor for that set, thereby generating a value comprising one parameter of the new event;

2) a means for converting the new event into a control signal;

and 3) a synthesizer for inputting the control signal and outputting a sound signal.

The invention as defined can realize many significant advantages.

For example, the invention can provide a new and useful way for processing music. To illustrate, it enables one to create a smooth and continuous transition between any two music inputs. For example, a user might gradually transform a Beethoven Symphony into a Tango dance. This is expected to become a very useful tool in film and multi-media application, where background music may be 'morphed' as one scene fades into the other.

One may also consider an advantage of the present invention to be its ready incorporation in an interactive virtual reality game situation, where the degree of resemblance to the first and second musical compositions can provide audio feedback that corresponds to a redefined disposition of the game.

A further advantage of the invention is that it can provide a way for a non-musician to explore different expressive interpretations of a musical work. For example, different performances of Beethoven's Moonlight Sonata made by various performers might be the music inputs. During the morph, a user could create his own expressive interpretation by moving in the 'expressive' space of these performances.

Another advantage of the present invention comprises its realization as a compositional tool for creating new musical materials. For example, a film scorer who is requested to compose a new 'chase' scene might do so very quickly by morphing between several of his older works that are similar in character. The result could easily produce a completely original work.

We further note that an advantage of the present invention references the fact that an input comprising a "first and second musical composition" comprehends inputs that comprise any sounds including bird songs, waterfalls, thunder, machines, or speech, including the declamation of text.

BRIEF DESCRIPTION OF THE DRAWING

The invention is illustrated in the accompanying drawing, in which.

DETAILED DESCRIPTION OF THE INVENTION

Compositional Morphing in Musical Terms

Figure 1:
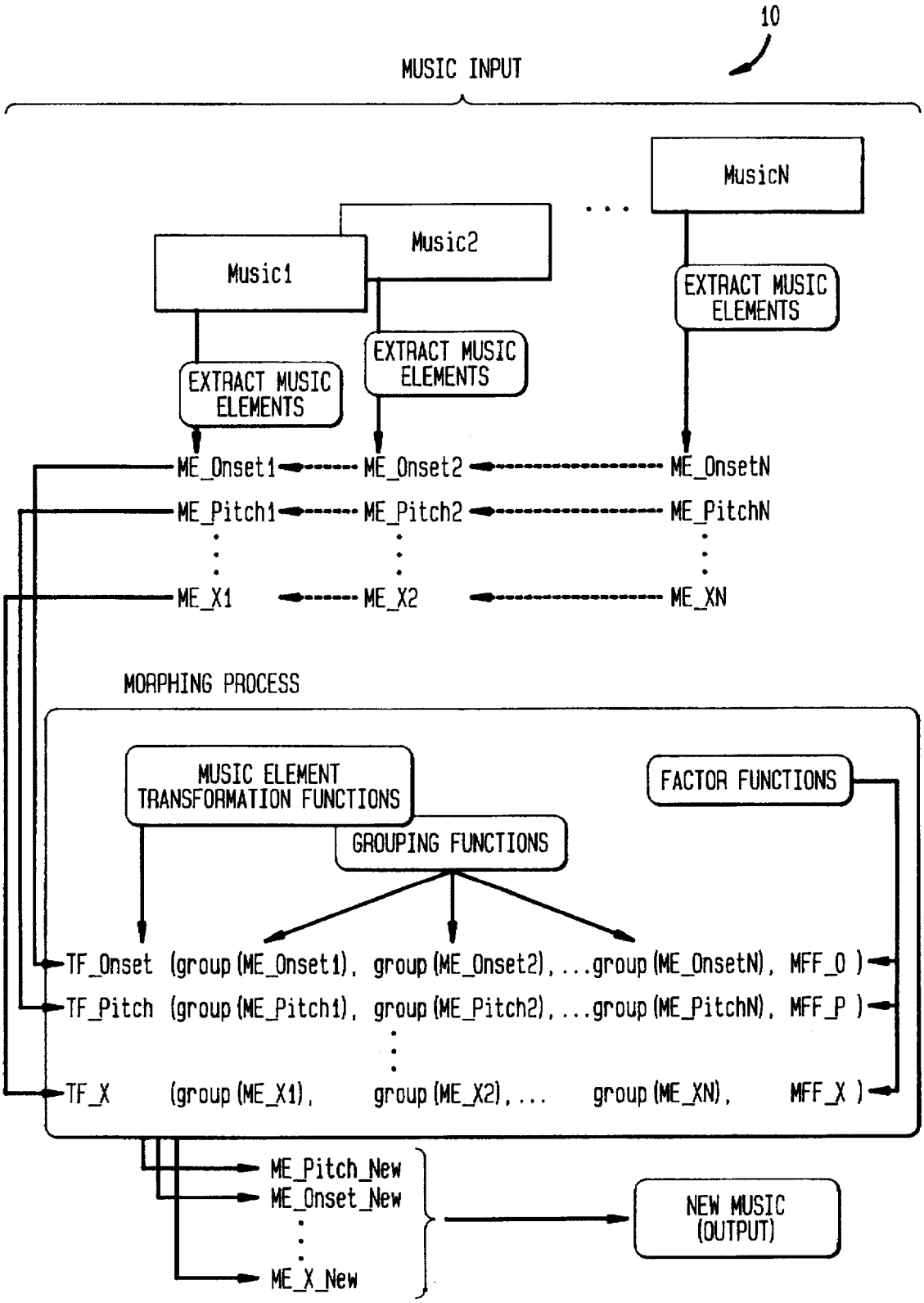
FIG. 1 shows an overview of a morphing process.

Compositional morphing is a process that can generate a sui generis musical work by reworking musical elements extracted from any number of music inputs in varying degrees of similarity each input. Each music element, i.e., melody, rhythm, articulation, etc., may be processed using any one of a variety of transformations. Not all elements need be transformed and some may remain unchanged. A typical morphing process will use two music inputs and transform one, the source, into the other, the target. However, the number of music inputs used in a morph is not limited.

A goal of a morph process is to produce a smooth mutation from one music into another. The 'quality' of this process can be measured in subjective terms: does the listener indeed perceive a gradual transition from one music into another, and can he relate the new motivic elements as they appear to their music origins?

Compositional morphing is described here in terms of musical concepts, and is based on music theories that deal with Thematic Development. A listener's perception of music is both subjective and influenced by the surrounding musical context. A listener might focus on different thematic elements each time he listens to the same music. A morphing system must therefore be open ended and sufficiently flexible to adapt to an endless world of musical situations. A composer using the system must be able to choose from each music input the motivic elements he will manipulate. There are many different algorithms for processing a music element in which musical elements can be transformed, and these methods should all be accessible within a system. The choice of a specific transformation for a given music-element type will determine the characteristics of the new music. In some situations, the entire family of musical elements may be transformed, whereas in others some musical elements may remain unchanged by the process. As Schoenberg put it: "Tonality and rhythm provide for coherence in music; variations delivers all that is grammatically necessary. We define variation as changing a number of a unit's features, while preserving others." ("Connection of Musical Ideas," from *Style and Idea*).

Compositional Morphing vs. Mixing, Spectral Morphing, and Visual Morphing

Compositional morphing varies fundamentally from mixing, spectral morphing, and visual morphing. Audio mixing can be regarded as a limited case of morphing involving only one musical element: volume. Compositional morphing will typically transform several other elements, namely pitch and rhythm. Another fundamental difference is that all intermediate stages of a mix include all the musical elements from all the mix inputs, whereas a morph will produce a single sequence of musical elements that is derived from all music inputs.

Spectral morphing manipulates wave files in the frequency domain. It transforms sound, or timbre, but does not manipulate music on a compositional level. Spectral morphing does not extract or rework musical elements as such, has no notion of notes or events, and cannot directly relate to motivic characteristics. However, in some limited cases where the audio inputs are a monophonic melody the effect could be similar to some degree.

In visual morphing one image is mutated into another in a way that is similar to spectral morphing and not compositional morphing. A visual analogy of compositional morphing could be made using scenes taken from two cartoons, say Donald Duck and Spider Man. Not only would the image of Donald Duck have to mutate into Spider Man, but also the whole plot, series of actions, background props and scenery would have to gradually transform from one into the other.

Types of Morphing

There are several fundamental ways in which music elements can be treated. We differentiate between two types: context independent and context dependent transformations. In the former, transforming a given value is done disregarding other values, whereas in the latter other values of the same or different type are also considered. A morphing process could incorporate any combination of the following, and a different method could be applied to each music element. Observe that each transformation would be used for transforming only one element type. For generating a new note each one of its parameters would first be calculated using any of the following methods.

Context Independent Transformations

1. Recombination

Here a music element for the new music preferably is selected without modification from one of the music inputs. The new music will have a unique family of music-elements that does not exist in any of the music inputs. For example taking the melody of one music and superimposing it with the rhythm of another. If we recombine a work by Bach with a work in Jazz style, we will end up with a 'Jazzed up Bach.

2. Interleaving

Here a new musical element is derived by alternately selecting one or more elements from each of the music inputs. Using the Bach and Jazz example from above, the new melody would be a sequence of one or more pitches from Bach, then from Jazz, then back to the Bach, etc. Note that other elements may undergo different transformations and that if, for example, rhythm is also interleaved then the selection of rhythms may not be synchronized with the selection of pitches.

3. Transformation

The previous two methods merely selected values from music inputs. Here, a new value may be calculated based on values from the music inputs. Interpolation is one obvious method in this category, but there are many others (see infra). Values can be:

absolute values, such as a pitch;

an interval (delta) between the current and next or previous value;

a contour, i.e., the direction of change from a previous value if plotted as a function or shape.

Context Dependent Transformations

1. Interleaving of Motives

This is a higher level manipulation where values in a given sequences are first grouped into motivic units. The interleave will occur only between complete units.

2. Transformation of Motives

Here motives are also first identified in each input, but a new motive is derived by a processing complete motives from each music input.

3. Parameter Synchronization

Often a motive is a combination of more than one element type, say both pitch and rhythm. In order to keep the identity of such a motive some values from different music-element types may be linked or synchronized to each other. In this way, if a pitch value is selected from one input then its rhythm would also be selected. This could be applied to both interleaving and synchronizing techniques, in both context independent and context dependent categories.

Diversity of Musical Situations

There isn't one 'correct' way to morph. Different musical materials possess different thematic characteristics. In one music, rhythm may be a key feature whereas in another it may be a melodic motif, harmonic progression, or any variety and/or combination of others. Then, one must also consider the desired musical result. For example, Beethoven used the famous motif that opens the fifth symphony mainly for its intervalic content in the first movement, but only for its rhythmic content in the Scherzo—by and large on a single pitch. Similarly, a morphing system should provide the same sort of flexibility, allowing the reuse of given music inputs to produce new and unique musical outcomes.

Here are some examples illustrative of this point.

1. Rhythm

When morphing two works that share the same time signature and tempo, does one want to enforce this tempo and time signature on the resulting music? If so, care must be taken to ensure that note events retain their rhythmic position in a measure. This strongly limits the type of rhythmic transformations that can be applied (see infra). On the other hand, if the meter can vary, then a much richer variety of rhythms can be generated producing a compound meter that is constantly changing (see infra).

2. Rhythm

Let us assume a morph between a Viennese Waltz in ¾ and an East European dance in a compound meter of ⅞. Assuming we want to maintain a dance quality, how do we transform the rhythms? If we use the rhythmic input from both sources, then rhythms that are not characteristic of either dance will be generated. In this case, it may make sense to use only one of the rhythms as a template in recombination.

3. Time onset

Consider two works, each with a base and lead part where the goal is to generate a set of melodic variations over a constant base part. Here it makes sense to treat each part separately. One bass part could be selected from one of the two works. Now, the composer might decide that new melody notes must retain their metric positions from the input melodies so that they will remain synchronized with the bass line (i.e., select a time synchronized grouping, see infra). If the two works are in a different key, or have a different harmonic structure, then the resulting music must also make sense in terms of both key and harmonic progression. Here, again, recombination might be used so that the key or harmonic progression from one music will serve as an unvarying grid.

4. Pitch

Consider a case in which the music inputs are a Classical work and a Jazz improvisation. If the morph only functions on rhythm and always uses the pitches from the Classical work, then the effect would be of 'Jazzing up' that Classical work.

5. Timbre

Assume a morph from a Latin percussion drum set into a piano solo. How does one treat timbre? Once choice could be to select either the drums or the piano as a constant timbre. If the same synthesis algorithm is used to generate all instruments then something analogous to spectral morphing could be obtained by mutating the synthesis parameters from one instrument into the other. In MIDI based systems the velocities of the different instruments could be scaled to produce a simple mix from one timbre to another.

From Concept to Practice: Mapping Onto an Internal Music Representation

Whereas morphing is defined in terms of musical concepts—thematic properties—it is preferably carried out in a computer system by manipulating some internal representation. In order to understand some inherent limitations of such a system, one must first understand how these musical concepts map onto the computer's internal representation.

Computers can generate music by controlling a synthesis device. The composer preferably depicts music through some internal representation; the most common being a Score. A score comprises a collection of events; the most common event type is a note. Each event has a collection of attributes referred to as parameters. Different score formats, or music representations, may define different parameters for note events. Typical parameters include onset-time, instrument (timbre), pitch, duration, and loudness. In environments that support sophisticated synthesis algorithms, such as additive synthesis or physical modeling, many more parameters may he specified. Sometimes parameters have musical meaning, such as loudness or vibrato rate, but at times their meaning can only be understood in terms of a control signal, such as carrier #4 modulation index. Parameters can be fixed values or functions of time.

Musical morphing is defined here in terms of musical elements. The computer, however, can only manipulate score parameters. Morphing can be implemented successfully only in as much as score parameters map 'correctly' onto musical elements. The 'correctness' of this mapping is subjective, and would differ considerably depending on the specific music sources and the desired musical outcome. In most cases pitches and rhythms map well from parameters to elements, but there are numerous cases when they do not. This problem becomes especially acute when the sound, or timbre, does not resemble conventional acoustic instruments. Systems that implement Perceptual Parameters, i.e., a mapping of user defined attributes onto many control parameters, seem especially promising for this application.

One should also keep in mind that music theory identifies many elements which are not part of most music representations, such as harmonic function, encapsulating motive, rhythmic position, density, etc. By extending the music representation these elements could, in theory, become available for mutation in a morph. However, some musical parameters are not easy to define, such as those associated with expressive nuances of a live performer. Until such nuances will be defined, if indeed they ever can be, morphing such attributes from one music into another can be successful only to the degree that these attributes are manifested in other elements, such as loudness or rhythm.

A Formal Definition of Morphing

In the following discussion, we are isolating and examining the syntax of music in a way that maps well onto the formal representations of music that are commonly used in computer systems. In doing so we are admittedly ignoring all issues relating to the perception or meaning of music.

For the purpose of representing music in a computer, a musical work can be defined and made unique by the collection of its notes. Each note has one or more attributes, such as onset-time, pitch, duration, loudness; in computer music these attributes are referred to as parameters. Each note is defined and made unique by the specific value of each attribute; two isolated notes are considered identical if the value of each attribute type is identical. If a musical work is defined by the sequence of its notes then it follows that it is also defined equally by the sequence of each note's attributes.

As an example, we will assume a musicA with notes that have only three attribute types: Onset, Pitch, and Duration, indicated by the letters O, P, and D respectively. we call the collection of musical elements the family of elements. (the reader can easily expand the following examples for notes with element families of any size.) This music can be described using an array:

| MusicA | | | |
|---|---|---|---|
| $O_1$ | $O_2$ | $O_3$ | ... $O_n$ |
| $P_1$ | $P_2$ | $P_3$ | ... $P_n$ |
| $D_1$ | $D_2$ | $D_3$ | ... $D_n$ |
| Time → | | | |

If we examine this array vertically, i.e., group all attributes sharing the same index, we get notes (N). A Note is defined by the collection of its attributes:

$N_i=\{O_i,P_i,D_i\}$

If we look at this array horizontally, i.e., group all the attributes of the same type, we get a sequence of values that are called a Music Element (ME). A music element is defined as a sequence of all the values of a certain attribute type in a given musical work (i.e., pitch or melody, rhythm, duration, etc.). In computer music systems this is often referred to as a Parameter-Field. For Pitch this would be:

$ME_{pitch}=\{P_1,P_2,P_3, \ldots, P_n\}$

Hence a music can be defined either by the sequence of successive Notes (and their attributes) or by the collection of each Music Element (and its values):

$$\text{Music}_A=\{N_1,N_2,N_3,\ldots,N_n\}=\left\{\begin{array}{c} ME_{onset} \\ ME_{pitch} \\ ME_{duration} \end{array}\right\}$$

This is summarized by the following diagram:

MusicA

| | | | | | |
|---|---|---|---|---|---|
| MEonset: | $O_1$ | $O_2$ | $O_3$ | ... | $O_n$ |
| MEpitch: | $P_1$ | $P_2$ | $P_3$ | ... | $P_n$ |
| MEduration: | $D_1$ | $D_2$ | $D_3$ | ... | $D_n$ |
| Music Note: | $N_1$ | $N_2$ | $N_3$ | ... | $N_n$ |

To describe what happens in a Morph, let us examine a simple case where Music A and B are the inputs, and the generated output is Music M (note that the number of music inputs to a morph is unlimited). This can be described as follows:

| MusicA, input | | | | MusicB, input | | | |
|---|---|---|---|---|---|---|---|
| $O_1$ | $O_2$ | $O_3$ | ... $O_k$ | $O'_1$ | $O'_2$ | $O'_3$ | ... $O'_m$ |
| $P_1$ | $P_2$ | $P_3$ | ... $P_k$ | $P'_1$ | $P'_2$ | $P'_3$ | ... $P'_m$ |
| $D_1$ | $D_2$ | $D_3$ | ... $D_k$ | $D'_1$ | $D'_2$ | $D'_3$ | ... $D'_m$ |

| MusicM, morph output | | | |
|---|---|---|---|
| $O''_1$ | $O''_2$ | $O''_3$ | ... $O''_n$ |
| $P''_1$ | $P''_2$ | $P''_3$ | ... $P''_n$ |
| $D''_1$ | $D''_2$ | $D''_3$ | ... $D''_n$ |

Note that the number of notes can be different in each of the music inputs as well as in the resulting output, as indicated by k, m, n.

Pairing Parameter Sets

Each parameter value in the new music is a result of some function on parameter values from the music inputs. In most cases one would pair input parameters of the same type to produce a new parameter of that type. For example, assuming the first new pitch $P_1''$ was derived from the first pitch value in both music inputs ($P_1$ and $P_1'$) then:

$P_1''=f(P_1,P_1')$

However, a more general pairing might derive one parameter type from values of different types, such as:

$P_1''=f(O_1,D_1')$

We use the term pairing to define what elements types from each music input will be used to generate a given element type in the new music (output). Pairing of different music-element types seems less intuitive and may have a rather limited musical application. In order to simplify the following discussion we always assume a pairing of the same element types on both the input and output sides. The reader may easily expand our examples to include more complex pairings.

Morph Factor and the Morph Factor Function (MFF)

In order to describe the relationship of Music M to Music A and B at any given time, we define a function that we call the Morph Factor Function (MFF). This function returns a value, called the Morph Factor, that is between 0 and 1. The Morph Factor determines how similar Music M is to Music A and B. For a value of 0, Music M would be identical to Music A. For a value of 1 Music M would be identical to Music B. The Morph process can now be described as follows:

$\text{Music}_M=\text{Morph}(\text{Music}_A, \text{Music}_B, \text{MFF})$

In order to obtain a transition from Music A into Music B, i.e., that Music M will begin by being identical to music A and end by being identical to Music B, the MFF would have to return a value of 0 at the beginning of the morph and 1 at the end of the morph.

Music Element Transformation Functions

The value of each attribute in resultant MusicM is derived via a Music Element Transformation Function, or Transformation Function in short (TF). A different TF may be used for each music element type (i.e., pitch, onset, duration, loudness, etc.). This function takes as arguments the music element of that type from each of the music inputs, and a single Morphing Factor Function (MFF). For a music element of type X this would be:

$ME_{M_X}=TF_X(ME_{A_X},ME_{B_X},\text{MFF})$

Grouping

Each parameter in each new note (N) in resultant MusicM is derived via a Transform-Function from the parameters of 0 or more notes from each music input. The selection of these notes from each music input is called a grouping. Normally, only one note will be selected from each music input. As examples for selecting a different number of notes consider a case where a music input has a musical rest, then no notes may be selected from it, or the case of a chord, where several notes may be selected. The grouping function for a particular music input can be described as follows:

$\text{group}_A(\text{Music}_A,i)=[N_A]_i$ where $[N_A]_i$ is a subsequnce, possibly empty, of the sequence of music notes in MusicA. Observe that we do not insist that the length of $[N_A]_i$ is the same as that of $[N_A]_j$.

Later we will discuss in detail several grouping algorithms, namely Time Synchronized and Time Warped (see infra).

Generating Each New Note

The generation of each note in Music M can now be described via a Morph Transformation Algorithm:

$N_{M_i}=\text{Morph_Transform_Algorithm}(\text{group}_A(\text{Music}_A,i),\text{group}_B(\text{Music}_B,i), \text{MFF}(i))$ The value of each parameter in the new note was derived via a Music Element Transform Function (TF), therefore the above is equivalent to:

$$N_{M_i} = \begin{Bmatrix} TF_{onset}([N_A]_i,[N_B]_i,MFF_{onset}(i)) \\ TF_{pitch}([N_A]_i,[N_B]_i,MFF_{pitch}(i)) \\ TF_{duration}([N_A]_i,[N_B]_i,MFF_{duration}(i)) \end{Bmatrix}$$

Music Element Transformation Functions (TF) are later described in detail.

The Morph Algorithm

We can now expand the overall morph algorithm presented earlier:

$$\text{Music}_M=\text{Morph}(\text{Music}_A,\text{Music}_B,\text{MFF})$$

to:

$$Music_M = \begin{matrix} end\text{-}morph \\ \\ n=1 \end{matrix} \begin{Bmatrix} TF_{onset}(\text{group}(\text{music}_A,i_n),\text{group}(\text{Music}_B,i_n),MFF_{onset}(i_n)) \\ TF_{pitch}(\text{group}(\text{music}_A,i_n),\text{group}(\text{Music}_B,i_n),MFF_{pitch}(i_n)) \\ TF_{duration}(\text{group}(\text{music}_A,i_n),\text{group}(\text{Music}_B,i_n),MFF_{duration}(i_n)) \end{Bmatrix}$$

Transformation Functions and grouping techniques will be discussed in detail in following sections.

A Generic Morphing Algorithm

FIG. 1, numeral 10, describes a generic morphing algorithm that is based on the example described above. This algorithm describes the basic steps needed to generate each new note. It will end when all the events in the music sources have been scanned. The basic steps can be described as follows:

1. select the music inputs;
2. identify and extract the family music elements from each music input.

For each new event that is to be generated:

3. pair a parameter type from each input and assign it to one parameter type in the new event;
4. group the input notes that will be used to generate the properties of the new note;
5. assign each group a morphing factor for determining a relative weight of resemblance to each of the music inputs;
6. assign each group a transformation function for mapping the selected values in accordance with a morphing factor for that set, thereby generating a value comprising one parameter of the new event.

This algorithm will be refined as various problems are discussed. A more detailed algorithm is presented as a pseudo code, in Appendix A.

Morphing Music with Aid of a Computer

The Morph Engine

Figure 2:
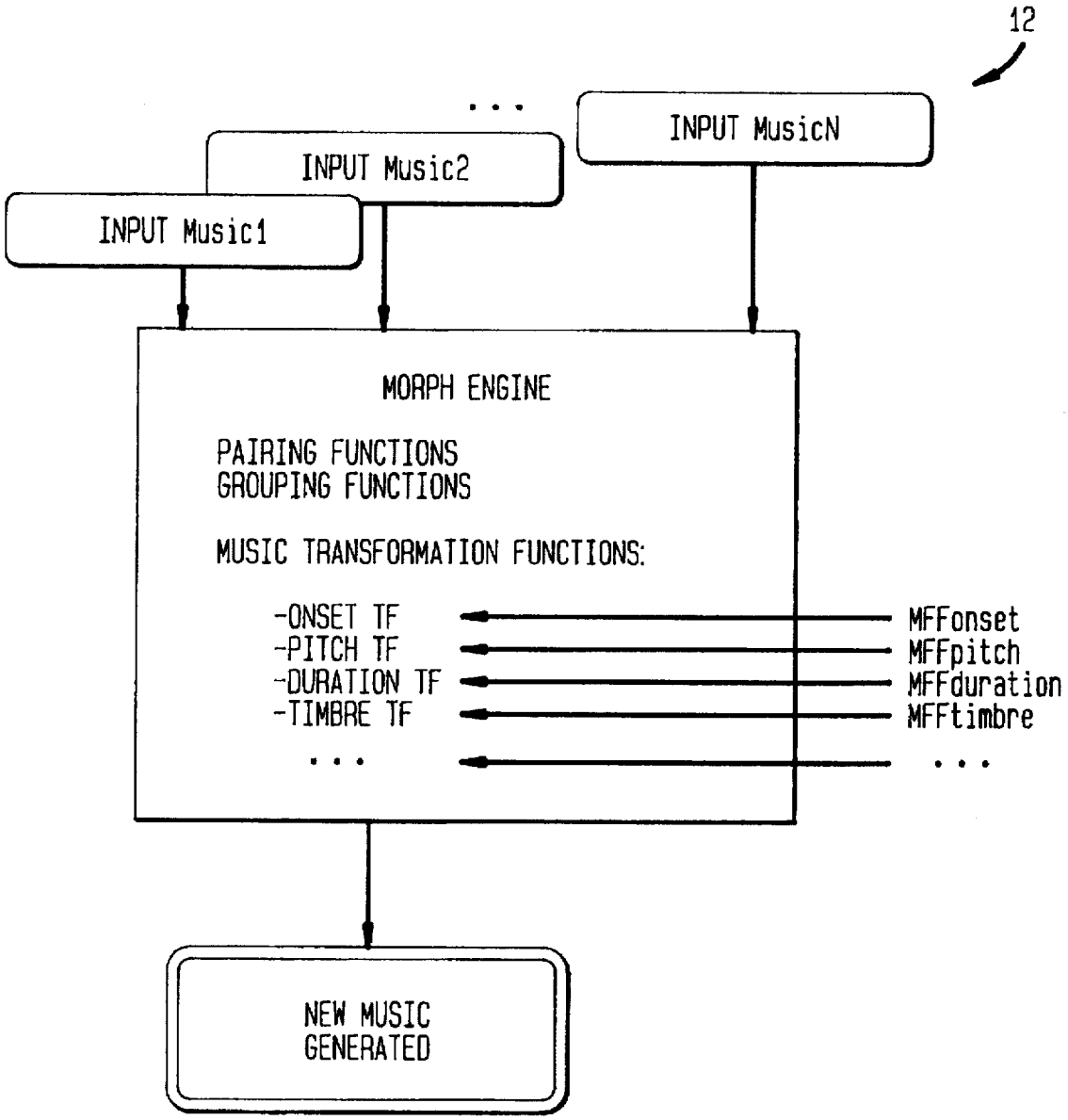
FIG. 2 shows a morph engine.

FIG. 2, numeral 12, shows a generalized high level layout for a Morph engine. The engine expects two types of inputs: music and factor functions. The Morph engine consists of a Grouping Function and a collection of Music Transformation Functions—there is one function for each music-element type.

Figure 3:
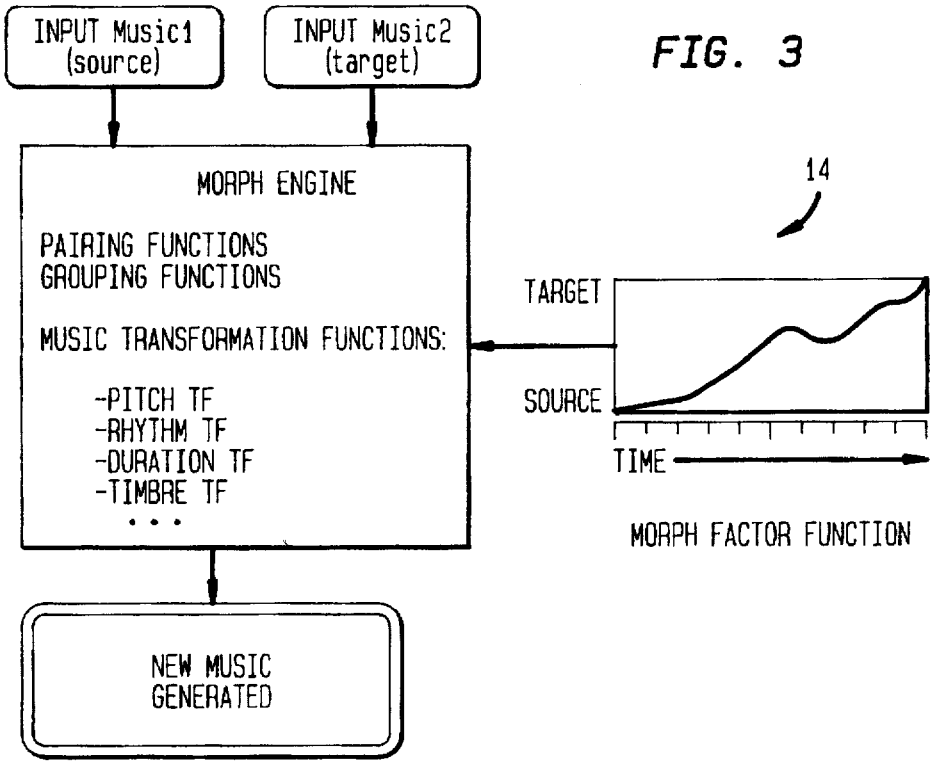
FIG. 3 shows a simplified version using a single factor function.

FIG. 3, numeral 14, is a simplification that uses only two music inputs and a single factor function that is shared by all transformation functions. This example is set to morph from Music1, the source, into Music2, the target. The Factor Function in this example will cause the new music to begin by sounding identical to Music1, the source, and end being identical to Music2, the target. In between, the new music will have unique musical characteristics, though it will always share thematic elements from both source and target music.

The music generated using the same music inputs, transformation functions, and factor functions will always be identical (unless random processes are used in any of the music transformation functions).

Interactive Morphing

Figure 4:
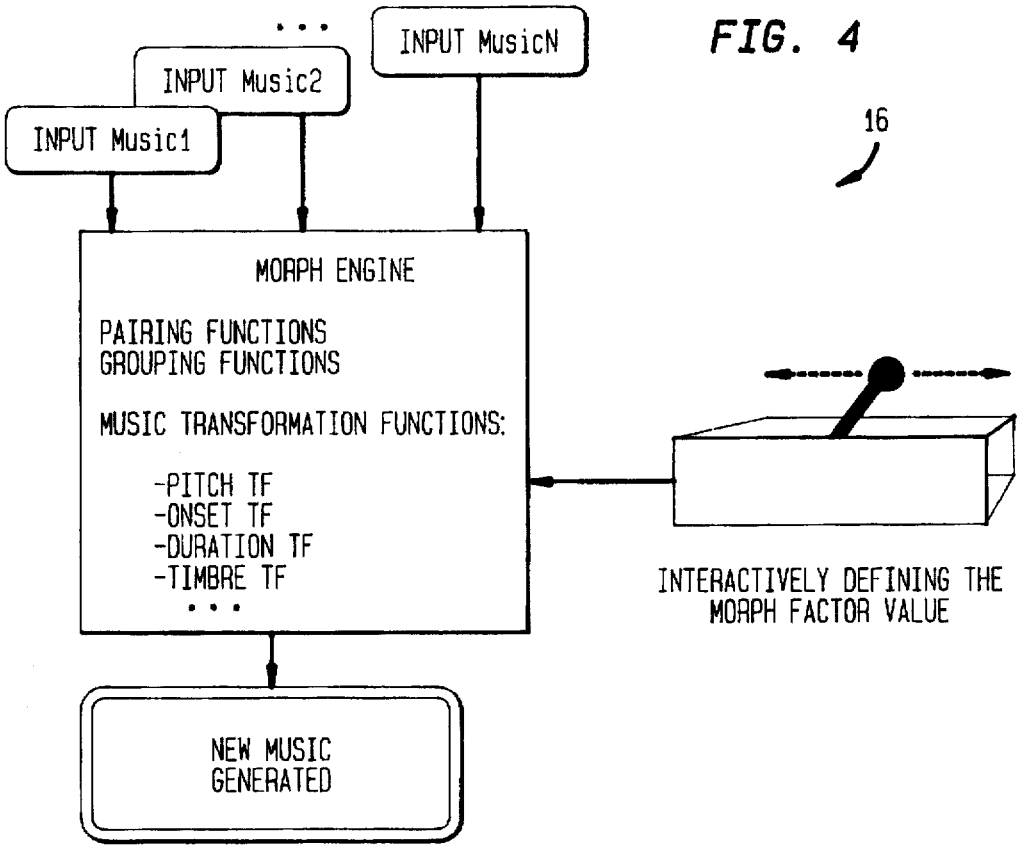
FIG. 4 shows an interactive morphing.

A morph system that can function in real-time can easily be made interactive. In the following example in FIG. 4, numeral 16, the Morph Factor Function is replaced by some input device, such as a mouse, joy stick, MIDI controller, or data glove in an immersive virtual reality environment. The position of this device at any given time determines the morphing factor. An added advantage of this arrangement is that the user input can be captured, refined, and then used as the Morphing Function in a non-interactive session. In this way the user may edit and refine the factor function until the desired music is obtained.

Unlimiting the Number of Music Sources

Figure 5:
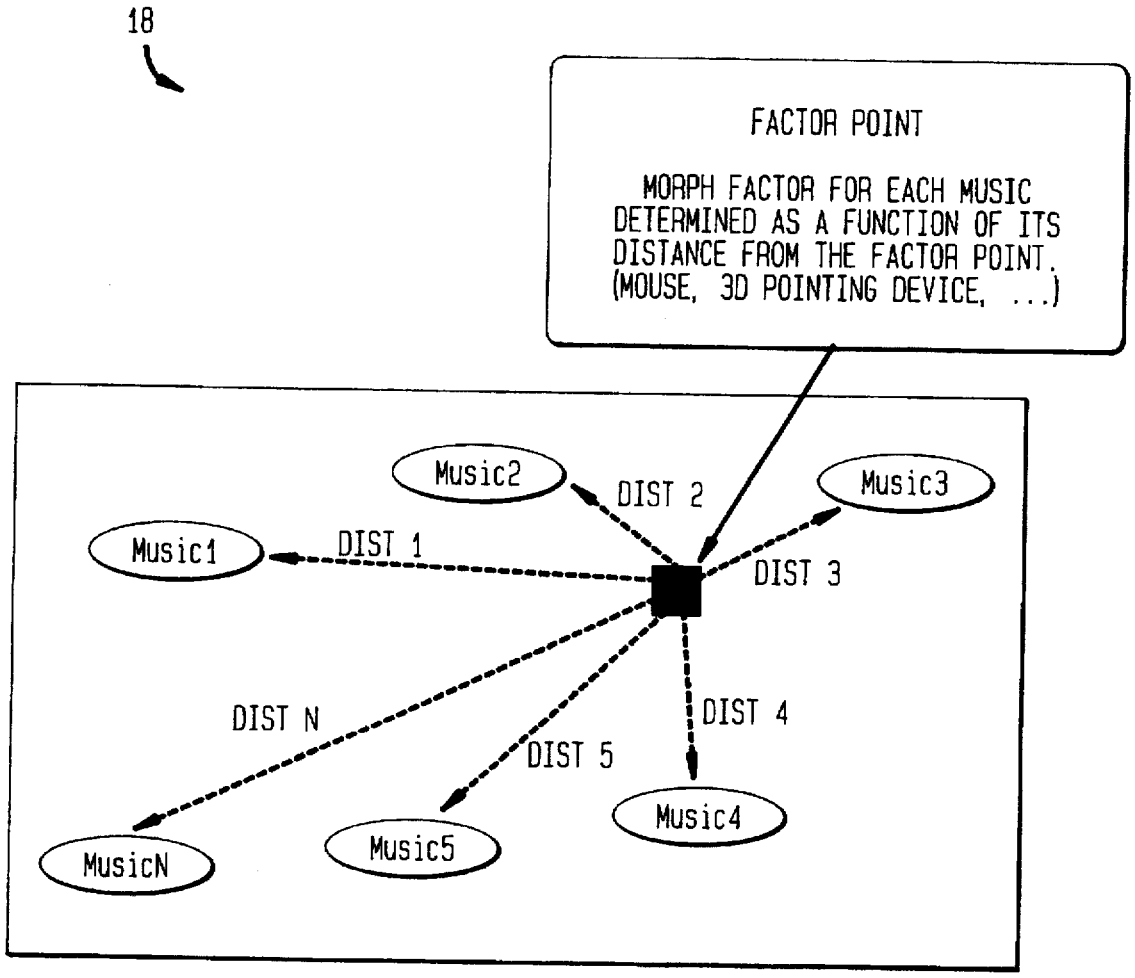
FIG. 5 shows morphing unlimited number of music inputs.

With little modification the number of music inputs that can participate in a morph can be made unlimited (see FIG. 5, numeral 18). The main problem here is in determining a morph factor for each music input without overly complicating the system. This can be done by representing each music input as a point in a 2 or 3 Dimensional space. In addition, one extra point is defined—the Factor Point. The morph factor for each music input is preferably then calculated preferably as a function of its distance from the factor point. The morph factor can be determined interactively by having the user control the position of the factor point via a mouse or other input device. The transformation functions must also be modified so that they can handle any number of music inputs.

Sources for Music Input and Output

Figure 6:
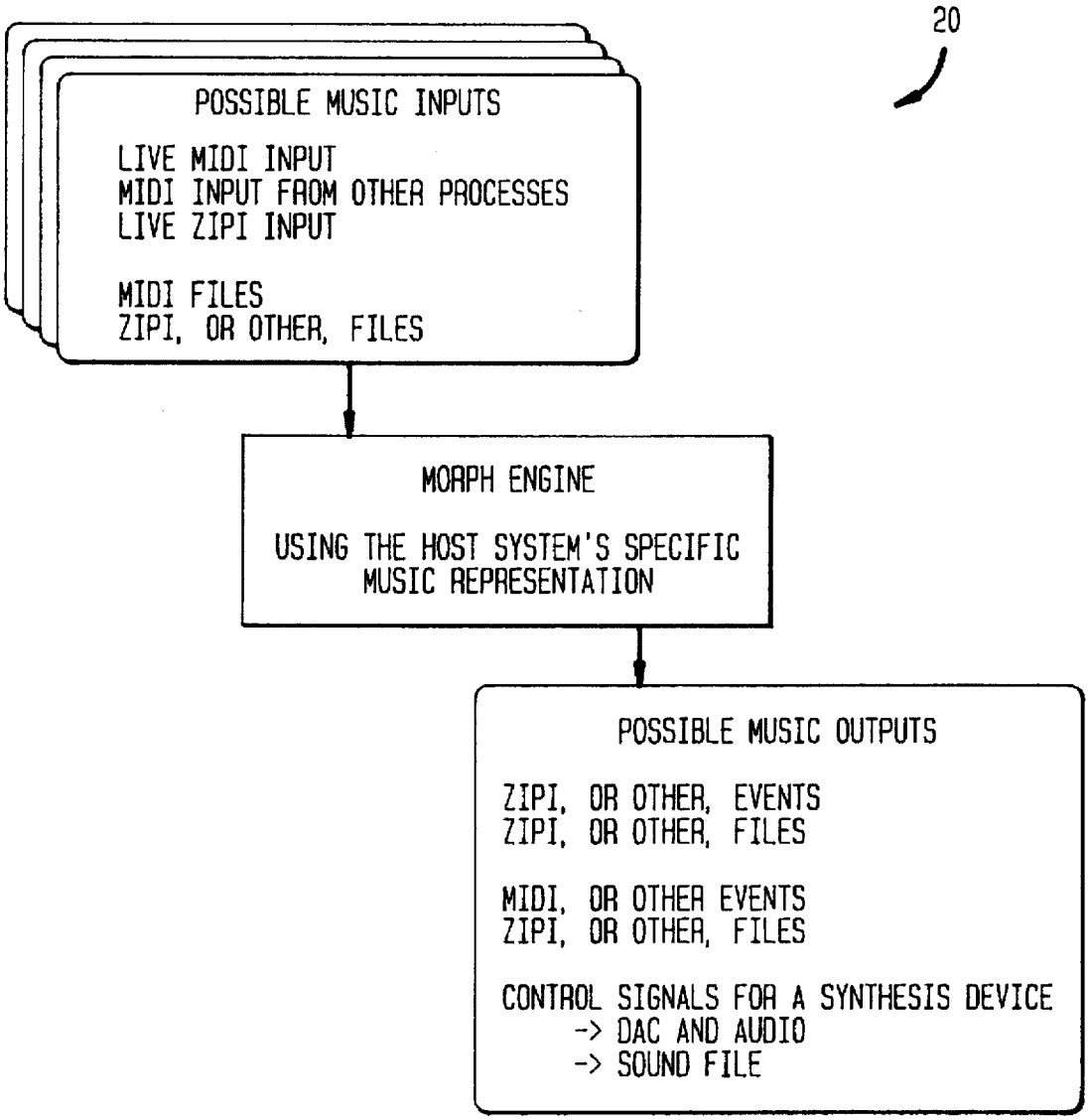
FIG. 6 shows possible input and output formats.

The morph engine could be implemented in almost any existing music system (see FIG. 6, numeral 20). The specific music representation used in each system may impose limitations on the system's capabilities, as has already been discussed in detail. Assuming that a music system can convert most standard music formats into its internal music representation, then the following input sources are plausible: MIDI files, live MIDI input, ZIPI events, various score file formats (Csound, Music Kit, etc.), an output of some algorithmic music generator such as from Common Music or another morpher. If the morpher is controlling a synthesizer that produces wave audio, then the music output will include all the above with the addition of audio sound and sound files. Using wave audio as a source for music input is possible in as much as there is a capability for an analysis into a score format and resynthesis from the transformed score.

Two input sources mentioned above deserve further attention. The first is live MIDI input from one or more performers. A second interesting input source is the output of another morpher or some real-time algorithmic music generator, that might itself be controlled interactively by a performer or some other process. Both options open interesting possibilities for performance and composition, facilitating a new kind of live interaction between performers and composers in real-time.

Grouping Input Notes and Determining New Onset Times

Polansky in his discussion of morphological mutation functions makes an assumption that both morphologies are of equal length (Polansky 91, p. 236). However, different musical works usually vary in duration, in the number of measures, and in the number of notes per each measure. This section presents several different grouping techniques devised to cope with these differences.

Figure 7:
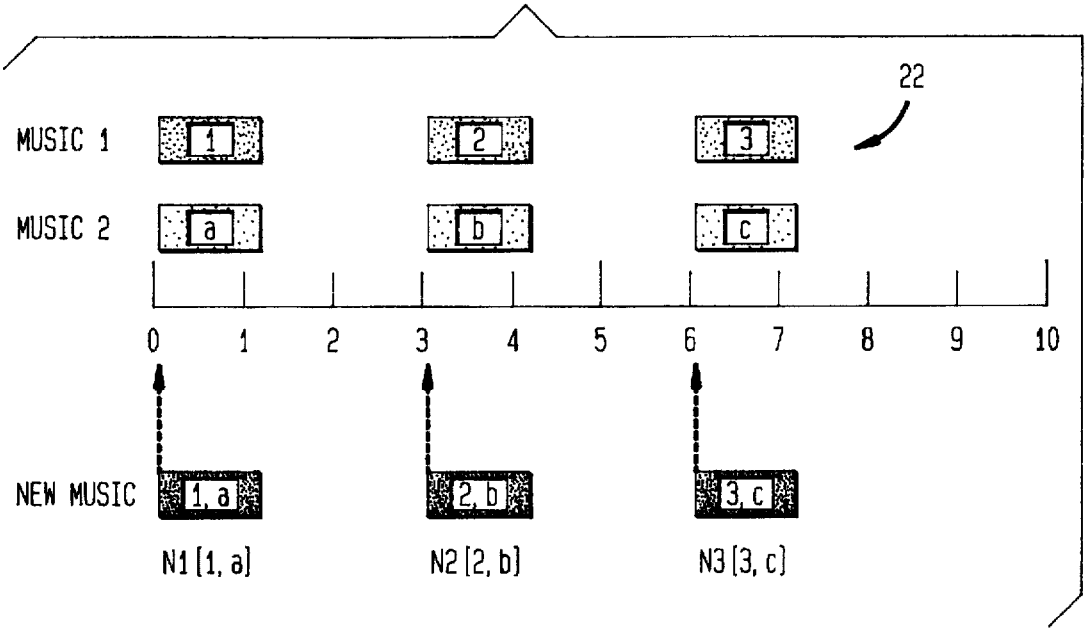
FIG. 7 shows note grouping.

Let us assume that morphing is taking place between two music inputs: Music1 and Music2 (see FIG. 7, numeral 22). We refer to notes in Music1 by numbers, i.e., 1, 2, 3, and to notes in Music2 by characters, i.e., a, b, c. The morphing process is to generate a new set of notes that we refer to as N1, N2, N3., etc. The parameters for each new note are derived from a pair of input events—one from Music1 and one from Music2 (note that some grouping algorithms may select 0 or more notes from each input). We refer to this pair as Input events and call the process of selecting each group or source events as grouping. We use square brackets to denotes the origins, i.e., groupings, that generated each new event. In the following example, three new notes are generated: N1[1,a], N2[2,b], N3[3,c].

We include the onset time of an event in parenthesis. The three new events can now be notated in full as follows:

New note 1: N1(0) [1(0), a(0)]

New note 2: N2(3) [2(3), b(3)]

New note 3: N3(6) [3(6), c(6)]

The morphing algorithm has been described as a three phase process: grouping source events, determining an onset time; and deriving new parameters. We will now discuss in detail problems relating to each of these three phases.

Generic Grouping Methods

Determining the onset time for each note is more complex. We describe two generic methods: time Warped (WARP) and Time Synchronized (SYNC); many variations are possible. WARP grouping produces a more natural rhythmic transformation, but totally disregards the onset time of the source events in each grouping. However, every input note is guaranteed to be selected into one grouping. SYNC grouping selects input notes whose onset times are identical, or as close as possible to each other. In doing so some events may appear in several consecutive groupings whereas others may be skipped altogether.

Time-Warped Grouping

Figure 8:
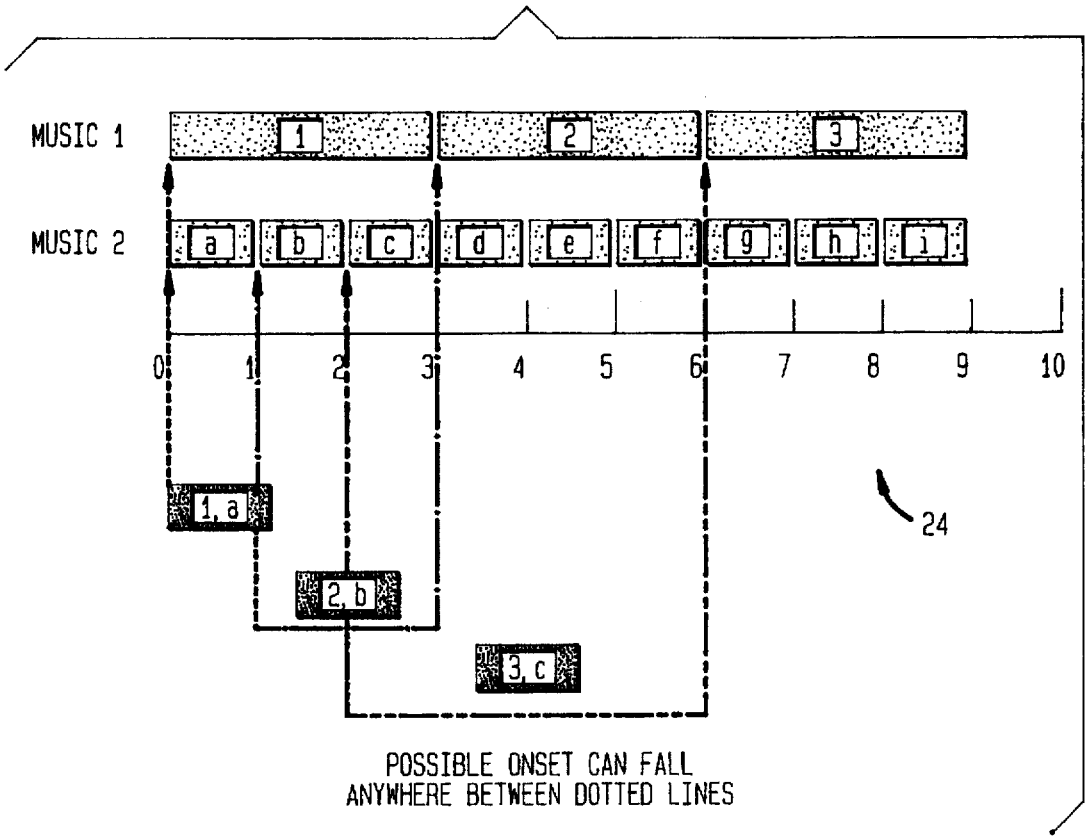
FIG. 8 shows a time-warped grouping.

Time warped grouping streams each music source and groups events in the order they appear: the Nth event from Music1 will always be grouped with the Nth event from Music2 (see FIG. 8, numeral 24).

The onset time for the new note can fall anywhere between the onset times of the input notes; this will be determined by the specific transformation function and current morphing factor. For example, the onset of the 3rd note can be time unit 2, 6, or anywhere in between.

This method warps time: in the example above in FIG. 8, the onset time of new events can occur before of the onset time of their source events in Music1 and after the onset time of their source event in Music2. Music1 seems to speed up whereas Music2 slows down.

It is also important to note that the thematic characteristics of new events are not time synchronized with their origins in the music sources. For example, consider a situation in FIG. 8 where the onset selected for the third new event is 2, generating: N3,(2) [3(6), c(2)]. In this case the new event is derived from event 3 in Music1 that is 4 time-units in the future. This problem becomes more acute as the number of notes per time unit in one input increases relative to the other.

Time Synchronized Grouping

Figure 9:
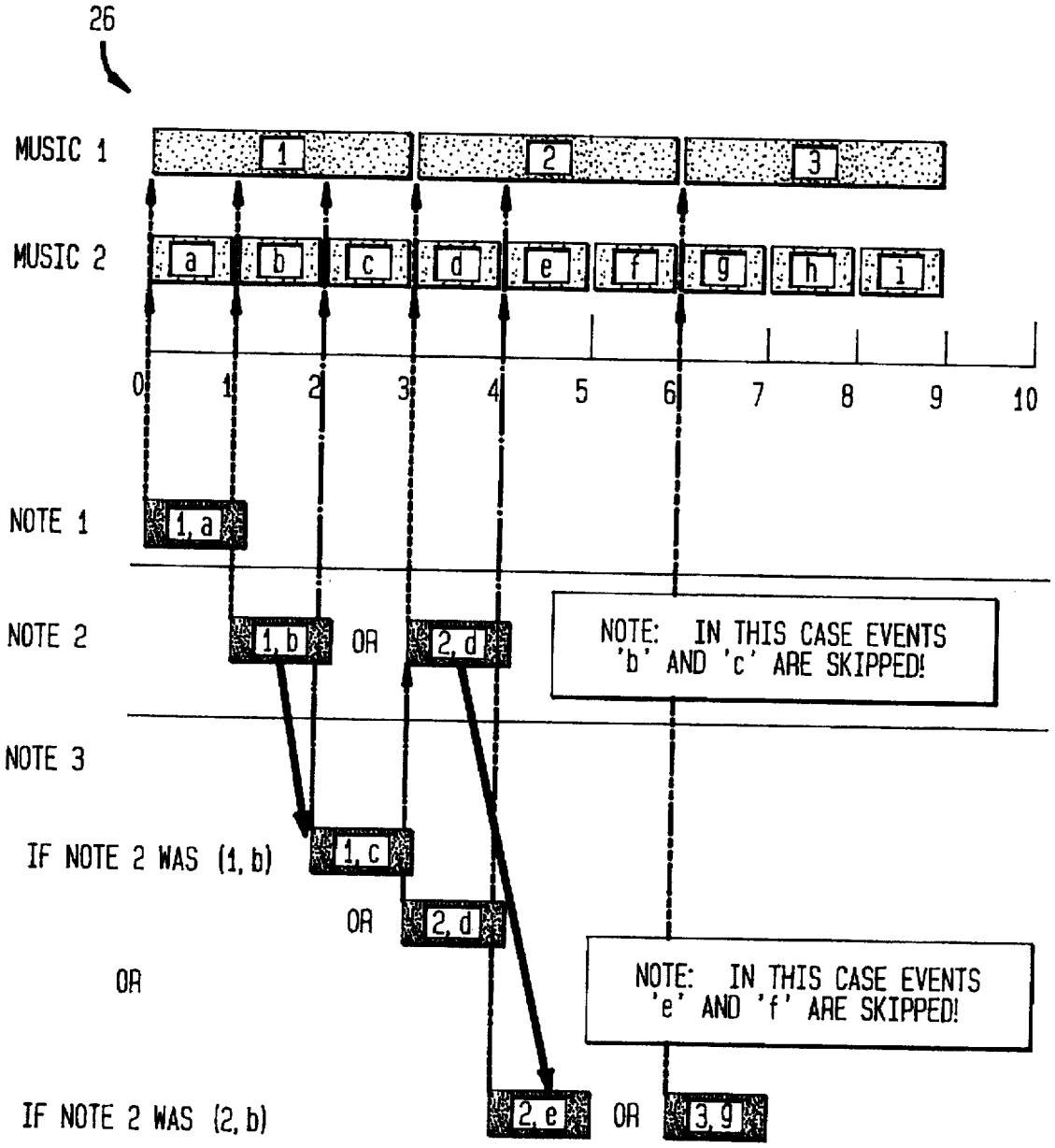
FIG. 9 shows a time synchronized grouping.

The Time Synchronized method (see FIG. 9, numeral 26) groups input notes with identical, or as close as possible, onset times. All input streams peek their next onset-time and one onset is selected. All streams are then advanced while their next onset time (i.e., peek onset) is smaller than the selected onset. Using this method some streams may not advance at all whereas others may skip over several notes. However, this ensures that each new output note is generated with an onset time that is as close as possible to its input note. If the onset transformation-function is performing a selection then each new note will share an onset with at least one input note. The musical characteristics of each new note will always be derived from events sharing the same, or very close, time location in all music inputs.

The choice of a specific onset time will determine the grouping used for deriving the next event, and this in turn will affect the characteristics of the next event. In the example in FIG. 9, after the first note is generated there are two possible onset times: 2(3) and b(1). If onset time 1 is selected, then the new event will be N2(1)[1(0) , b(1)]. But if onset 3 is selected, then the new event will be derived from entirely different inputs: N2(3)[2(3), d(3)]. Note also that in this case source events 'b' and 'c' are skipped altogether. Similarly, if we continue from this position and end up with N3(6)[3(6), g(6)], then source events 'e' and 'f' are skipped.

Note that in every case the onset time of the new event is either identical to the onset of the grouped events, or is the smallest possible time-offset away from them.

Tempo Grouping, or Time Stretch

The synchronized grouping matches events by their onset time. This can be done using absolute time, i.e., milliseconds, or relative time, i.e., bar, beat, subdivision and tempo. If two works are of a different duration, then one of two things are most likely to happen:

1. Morphing will take place only until the end of the shortest work.
2. When the shortest work ends some section of it is replayed until the longer work has ended. Typically, a short work could loop back to its beginning or to a point in time such that both works will end at the same time.

Time stretch modifies the tempo of the works so that they all end at the same time. Then, grouping is similar to the Synchronized method, only here events are not grouped by their relative onset times (i.e., measure, beat, beat division), but by their absolute onset time.

Minimal Delta Time Grouping

Figure 10:
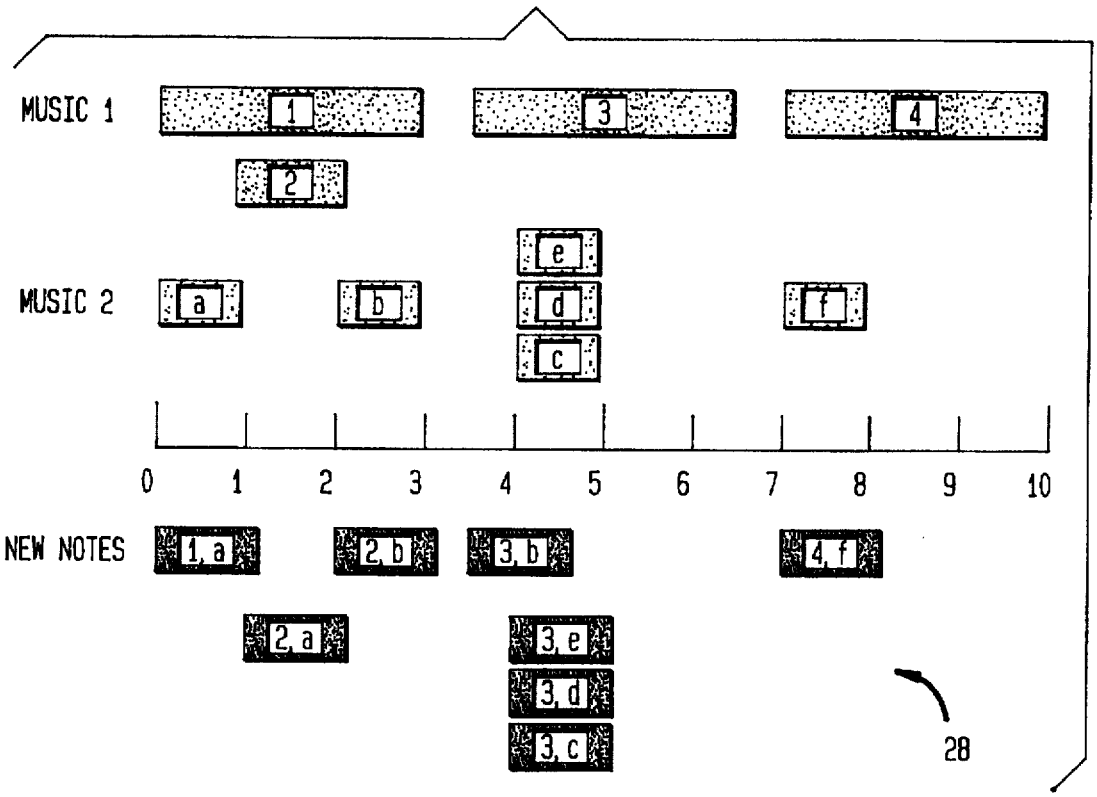
FIG. 10 shows a minimum time grouping.

This grouping creates a new note for every note in every input (see FIG. 10, numeral 28). It does so by scanning the delta times in each music input and always selecting the smallest, completely ignoring the morph factor.

As this grouping merges the rhythms of all inputs its use may be limited to certain musical situations. This grouping could be useful if some analysis program would scan the music inputs and change grouping functions on the fly according to redefined conditions.

Maximum Delta Time Grouping

Figure 11:
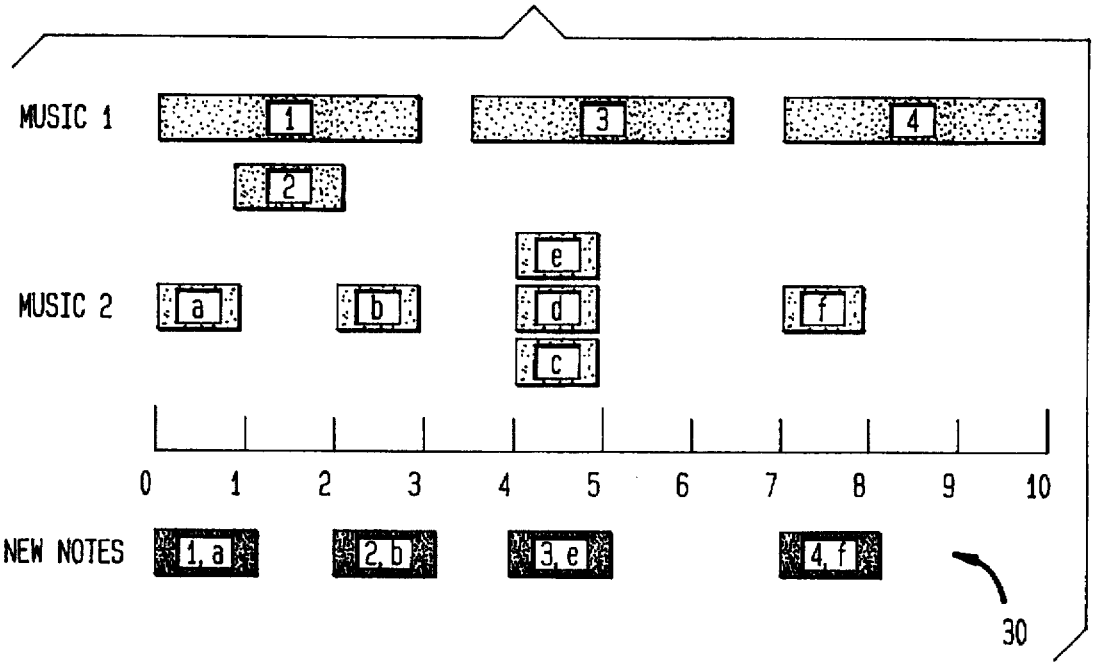
FIG. 11 shows a maximum time grouping—a possible outcome.

This grouping is a complement to the Minimum Delta Time grouping (see FIG. 11, numeral 30). It can select the largest delta time from all music inputs, causing many input notes to be skipped. Again, the use of the grouping may be limited to very specific musical situations.

Music Rests

Figure 12:
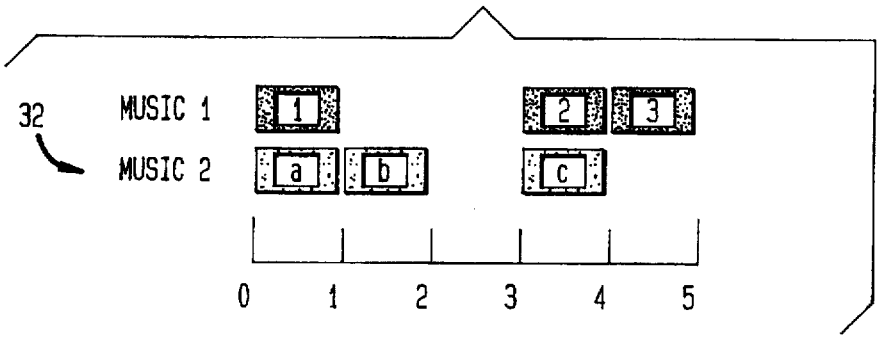
FIG. 12 shows music rests—which note should be grouped with b?

In the previous discussion, we assumed that a grouping always selects one note from each music input. This avoided the question of how to handle a musical rest in one or more of the music inputs. Let us examine what sort of grouping will occur with note b in Music2 in a following example (see FIG. 12, numeral 32).

Figure 13:
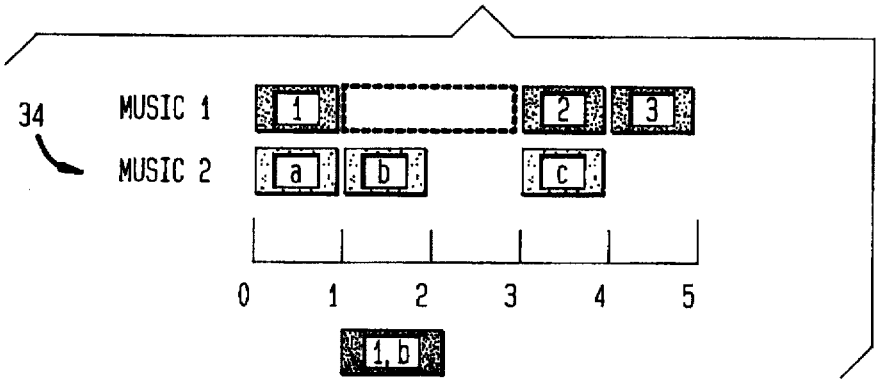
FIG. 13 shows music rests—stretching note durations (using a synchronized grouping)

There are two basic possibilities. The first is to treat note 1 as if its duration continues up to the onset of the next note (2) (see FIG. 13, numeral 34).

A Synchronized grouping would then group note b with 1. A Warped grouping would be unaffected in this case. Note b would be grouped with note 2. In other words, Warped grouping ignores rests altogether.

Figure 14:
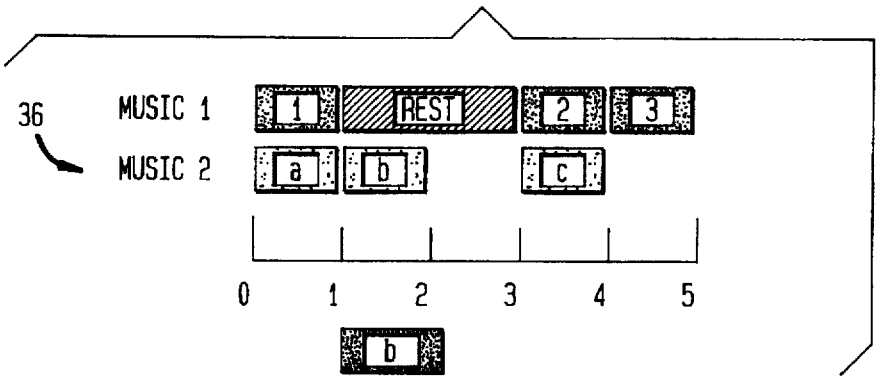
FIG. 14 shows music rests—inserting rest events.

An alternative is to treat the rest as a separate kind of event—a music rest (see FIG. 14, numeral 36). In this case a Synchronized grouping would group note b with a rest event. One probable way of handling rests is to have the Transformation Function ignore them. In this case note b would be the only input to the input transformation function and the new note would most likely be identical to note b.

Exactly the same result would take place with a Warped grouping, as note b would be grouped with the second event in Music 1, the rest.

An alternative technique for synchronized grouping that would yield identical results is simply not to group from an input that is resting. In this case only note b will be selected for the group and no note will selected from Music1.

Handling Chords

There are two distinct cases that should be considered when dealing with chords, depending on whether music inputs have the same number of notes in each chord.

Chords With the Same Number of Notes

Figure 15:
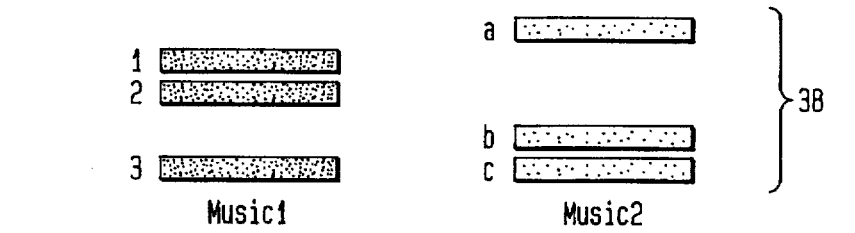
FIG. 15 shows chords with same number of notes.

In the example in FIG. 15, numeral 38, it makes sense that the music output will also have a chord with three notes. The question is what will be the pitches of each chord note. This situation is similar to spectral morphing. Several fundamental approaches exist:

1. Select one of the two input chords.
2. Select each pitch from one of the two input chords. Possible combinations are {1, b, 3}, {a, 2, 3}, etc.
3. Calculate new pitches from the given input. This is really not any different than transforming two melodies. It might make sense to group chord notes of the same level, i.e., bass1 with bass2, tenor1 with tenor2, etc. If this is the case then the music representation should ensure that notes occurring on the same onset are also sorted by their pitch value.

It should be noted that both time-warping and time-synchronized grouping methods will produce a reasonable result in this case.

Chords With Different Number of Notes

Figure 16:
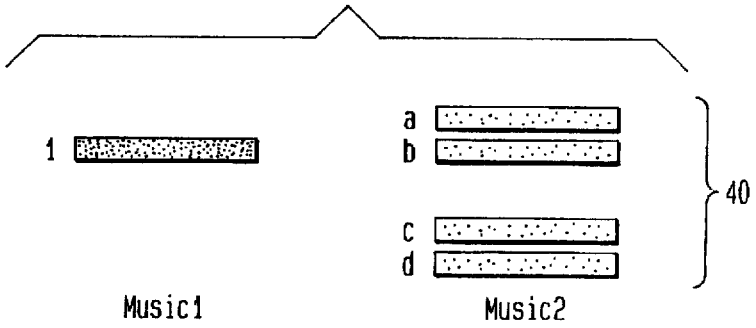
FIG. 16 shows chords with a different number of notes.

Let us examine an extreme case, where Music1 has only one note and Music2 has four (see FIG. 16, numeral 40):

The first problem is to decide if the music output should have a chord, and if so should the chord have 2, 3, or 4 notes? This decision can only be made on a case by case basis. Having decided to output a chord, the second problem would be to determine the pitches of that chord. Here are some options:

1. Treat the chord as a single event and generate only one note. Some processing of the chord would determine a single pitch value that will be grouped with the pitch of Note1.
2. Select the chord from Music2 as it is.
3. Determine the number of notes in the output chord, and select those number of notes from Music2.
4. Determine the number of notes in the output chord and then calculate for each chord note a new pitch by grouping Note1 from Music1 with each of the selected chord notes from Music2.

Time wrapped grouping will not produce any of the options listed above. It groups Note1 with one of the chord notes and then groups the next note in Music1 with the next chord note, and so on.

On the other hand, time synchronized grouping is more likely to come up with something reasonable. Most likely it will group Note1 with several of the chord notes. How many notes will get selected and whether all the chord notes will retain their structural identity will by and large be determined by the onset times of the notes that follow Note1. If the next onset is far away then there is a better chance that all the chord notes will in turn be grouped with Note1, retaining the chord identity. If, on the other hand, the next onset is close by some notes of the chords may get grouped with it, and the chord identity may be lost.

In order to ensure that chord entities are retained, a specialized grouping method needs to be devised. Another point to consider is a music representation with chord event types—this may help in getting more predictable results.

Transformation Functions

Polansky and McKinny describe several functions that can be used to mutate between two morphologies: Linear Contour Mutation, Irregular Unsigned Interval Magnitude, Irregular Signed Interval Magnetite, Uniform Unsigned Interval Magnitude, Uniform Signed Interval Magnitude, and Value Mutation (Polansky 87, 92, 95 and Polansky et. al. 91). Different types of functions transform different aspects of a morphology:

- the interval contour, i.e., the direction (sign) between two consecutive values;
- element magnitude, i.e., the absolute value of an element;
- interval magnitude, i.e., the signed (or unsigned) deltas between each two consecutive elements.

Some of Polansky's functions assume only two music inputs, and are further limited by requiring that both morphologies have an equal size. We are therefore suggesting the following as additional plausible functions:

Transform Functions that Consider the Morph Factor

1. Interpolation (linear, non-lineal).
2. Weighted Selection.
3. MIDI Mixing of timbre/instrument (channel/velocity).

Transform Functions that Ignore the Morph Factor

4. Minimum Value.
5. Maximum Value.
6. Average.

Transformation Function Arguments

All transform functions have the following signature:

$$\text{transform}\ (\text{val}_1, \text{MF}_{val_1}, \text{Val}_2, \text{MF}_{val_2}, \ldots, \text{Val}_n, \text{MF}_{val_n})$$

Additional Considerations

Some functions may be chained together to form a more complex function. For example, the output of the pitch Transformation Function might be combined with a map_To_Scale function that will ensure that the new pitch will be mapped onto a predetermined scale or harmonic function.

Examples Using the DMorph System

In the following section, we provide examples of morphing music with different combinations of Groupings and Transform-Functions. The results of these examples are notated so that the reader may examine in detail the effects of each combination on the morphing process. The notation was made from Midi files using Finale 3.0 with a Quantization of 1/32 and was not edited in any way.

Figure 17:
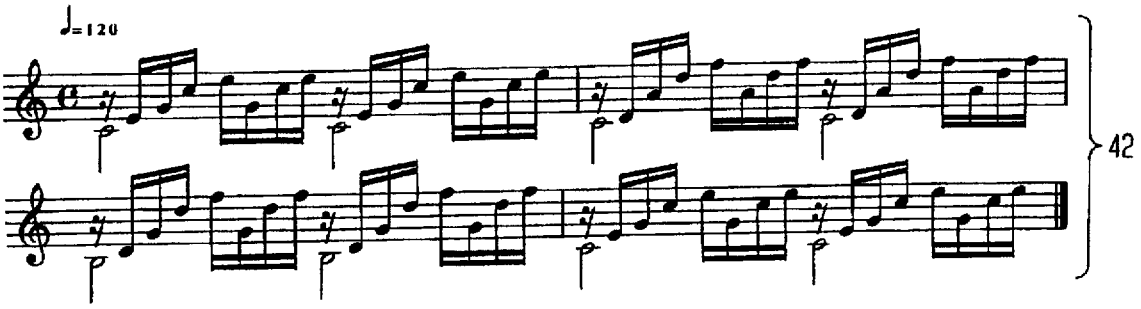
FIG. 17 shows the Bach Prelude in C Major.
Figure 18:
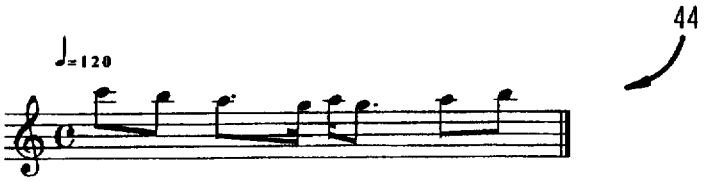
FIG. 18 shows a Scale melody.

Two contrasting musical works were chosen for these examples: the first 4 measures of the Prelude in C major by Bach (see FIG. 17, numeral 42), and a simple scale melody (see FIG. 18, numeral 44). To help the reader in tracing the effects of the morphing process the notation of the Prelude is slightly simplified and note durations are either half notes or sixteenth note. In contrast, the scale melody has varied rhythms and the pitches are all just above the range of the prelude.

The morph always begins with the Prelude, and then transforms into the melody. The same factor function is used in all the examples so that different examples can be compared with each other (see FIG. 19, numeral 46). The reader is encouraged to study the effects synchronized vs. warped groupings, the interchange of different transformation functions, and the inclusion or omission of certain parameter types from participating in the process. A table in each example specifies all morphing parameters: grouping methods (warped or synchronized), Transformation Functions (selection or interpolation), and for each parameter whether each source is participating in the morph process (ON or off).

Figure 19:
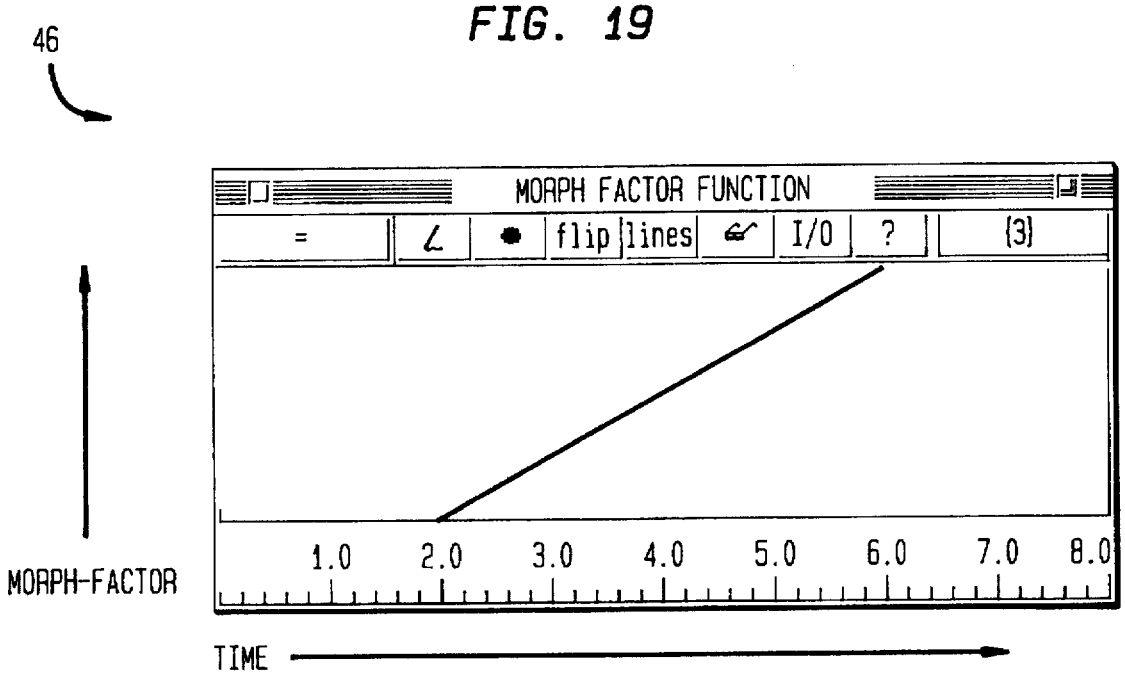
FIG. 19 shows a morph-factor function.

The factor function in FIG. 19 leaves the Prelude unchanged for the first two seconds, i.e., first measure. At the beginning of measure 2, a linear transition into the melody is made over a duration of 4 seconds, i.e., two measures. When the transition is over, the music output transforms into the melody. Note that depending on the grouping mode, the total duration of the morphing process may span beyond or under these measures.

Morphing Rhythm: WARP+Selection

Figure 20:
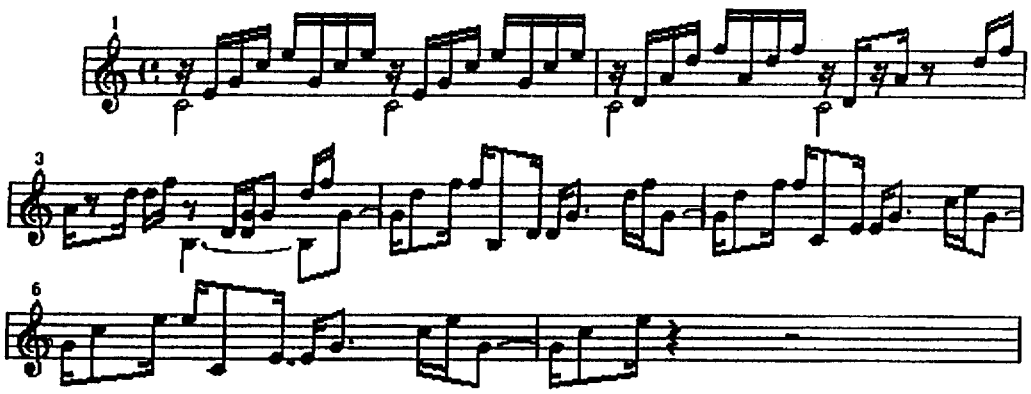
FIG. 20 shows a recombining of Bach pitches with interleaved Scale rhythms (time warped)

This embodiment is exemplified in FIG. 20, numeral 48.

The pitch sequence throughout is that of Bach. Rhythms are selected from either the Bach or the Scale. In the middle of bar 2 one can see that rhythms are beginning to change. Musical rests occur since the selection of note durations is not synchronized with the selection of rhythms.

By measure 4 the rhythm has transformed completely to that of the scale. Since the grouping in time warped the rhythm has shifted by 5/16 from its original beat position. Compare this example to the example in FIG. 22 infra where the only difference in the morph parameters is the synchronized grouping. There in measure 4 rhythms retain their original beat positions.

Morphing Rhythm: WARP+Interpolation

Figure 21:
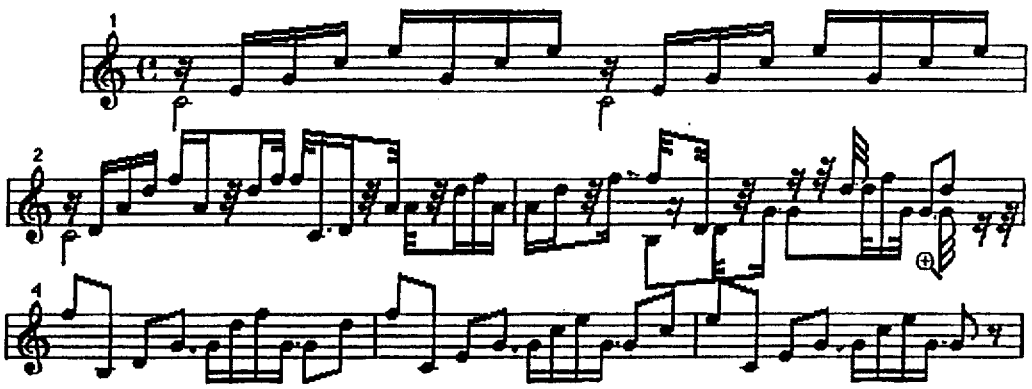
FIG. 21 shows a recombining of Bach pitches with Scale rhythms (time synchronized)

This embodiment is exemplified in FIG. 21, numeral 50.

This example is equivalent to the previous example, but here, rhythms are interpolated. Note that in measure 2 and 3 several 1/32 note durations occur. By measure 4 rhythms are once again exactly that of the scale, but are shifted by 1/8 in relation to their original beat positions. Note that the shift here (1/8) is different that the one in the previous example (5/16).

Morphing Rhythm: SYNC+Selection

Figure 22:
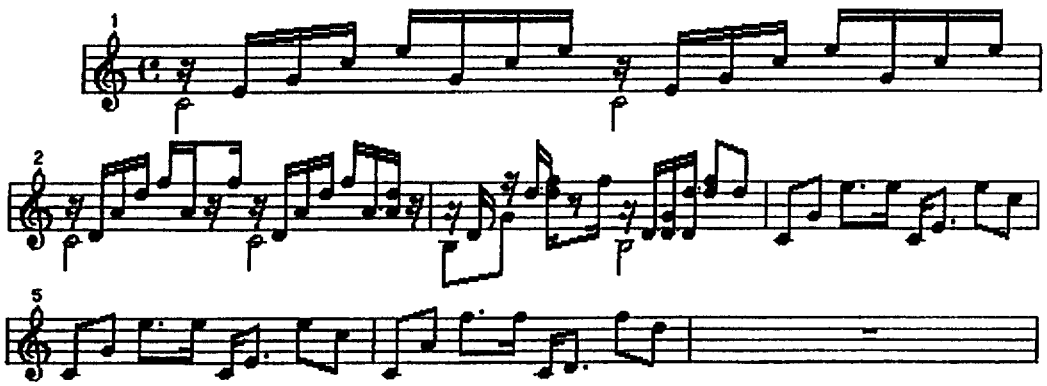
FIG. 22 shows a recombining of Bach pitches with interleaved melody rhythms (time synchronized)

This embodiment is exemplified in FIG. 22, numeral 52.

Compare this example to FIG. 20. Note that in Bar 4 the rhythms are synchronized to their original beat position in the Scale melody.

Morphing Rhythm: SYNC+Interpolation

Figure 23:
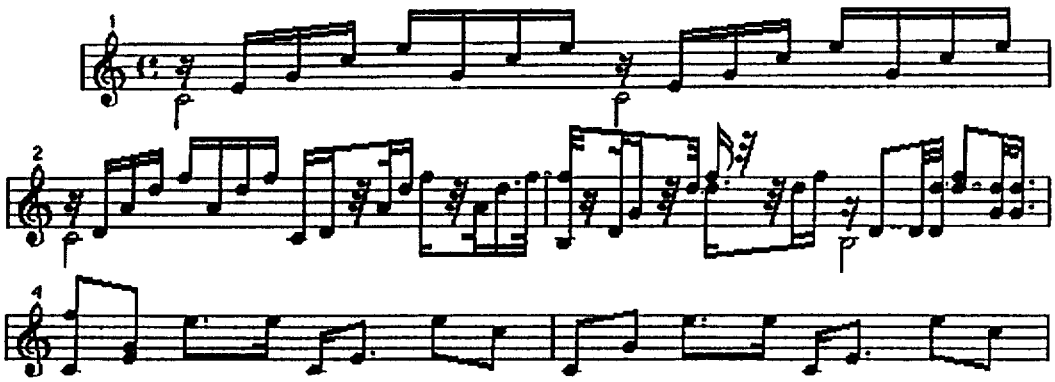
FIG. 23 shows a recombining of Bach pitches with interpolated melody rhythms (time synchronized)

This embodiment is exemplified in FIG. 23, numeral 54.

Compare this example to FIG. 21. Note that in Bar 4 the rhythms are synchronized to their original beat position in the Scale melody.

Morphing Pitch: WARP+Selection

Figure 24:
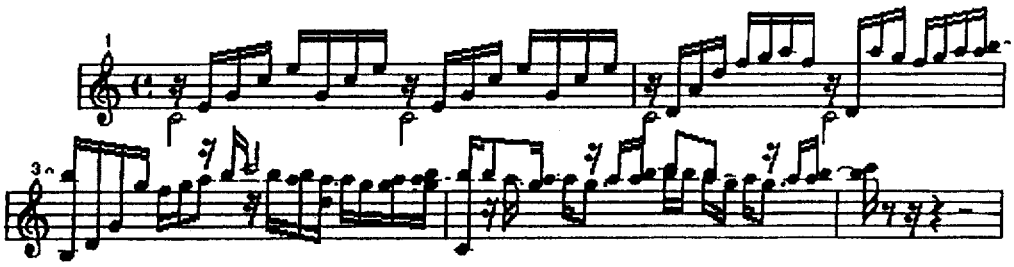
FIG. 24 shows an interleaving of both pitch and rhythms (time warped)

This embodiment is exemplified in FIG. 24, numeral 56.

Here both pitch and rhythm are interleaved. The rhythmic process is similar to that in FIG. 20. Note how in bar 2 and 3 pitches are interleaved from both Bach and the Scale.

Since the duration interleave process is not synchronized with that of the rhythms (or pitch), some note durations expand beyond the onset of the next note making the notation in bars 3 and 4 somewhat obscure. This was changed in the next example.

Morphing Pitch: WARP+Interpolation

Figure 25:
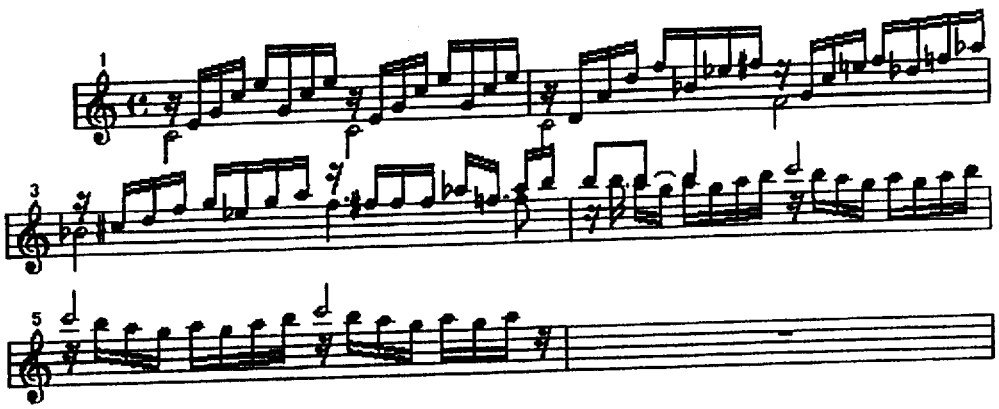
FIG. 25 shows an interpolating of pitch recombined with the Bach rhythm (time warped)

This embodiment is exemplified in FIG. 25, numeral 58.

This example differs from the previous in 2 main respects:

1. pitches are interpolated. Note that new pitches that do not belong to either Bach or the Scale are generated in bars 2 and 3.
2. Note durations are taken only from the Bach.

Note that even though the time mode is synchronized, the onset of notes in bars 4 and 5 happen to fall on the right bar locations.

Morphing Pitch: SYNC+Selection

Figure 26:
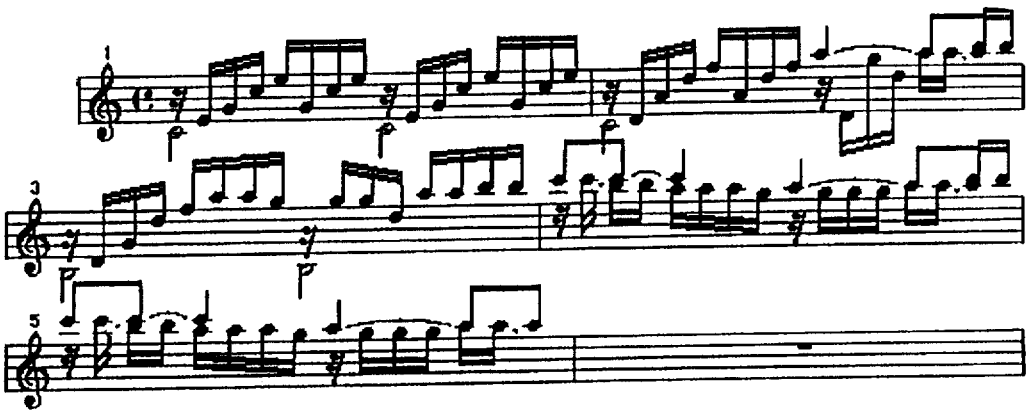
FIG. 26 shows a recombining of pitch and rhythm (time synchronized)

This embodiment is exemplified in FIG. 26, numeral 60.

Compare this example to the previous in FIG. 25. Here pitches are interleaved and only pitches from either Bach or Scale appear throughout.

Morphing Pitch: SYNC+Interpolation

Figure 27:
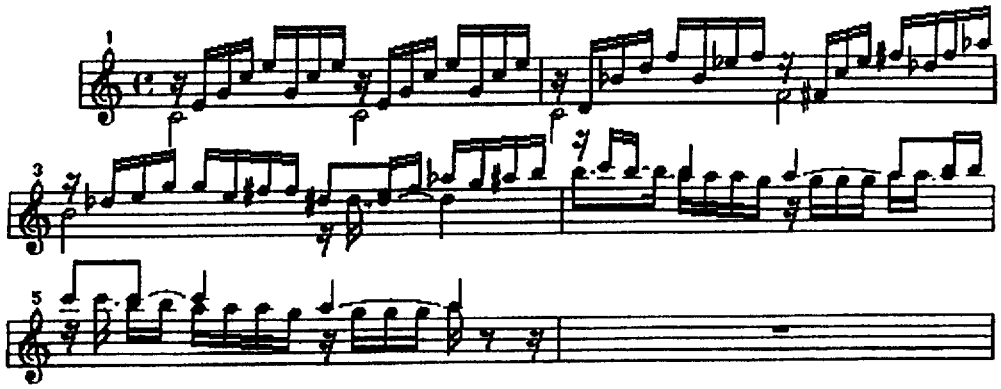
FIG. 27 shows a transforming of both pitch and rhythms.

This embodiment is exemplified in FIG. 27 numeral 62.

Here both pitch and rhythms are transformed.

Morphing Pitch and Rhythm: SYNC+Selection

Figure 28:
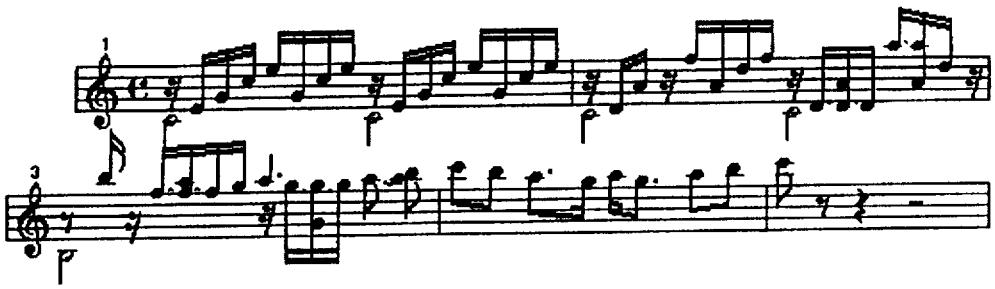
FIG. 28 shows an interleaving pitch, rhythm, and duration (time synchronized)

This embodiment is exemplified in FIG. 28, numeral 64.

All three parameters—pitch, rhythm, and duration, are interleaved here. Note that in bar 4 the scale melody appears in its unchanged version.

Bach to Mozart (recombination)

Figure 29:
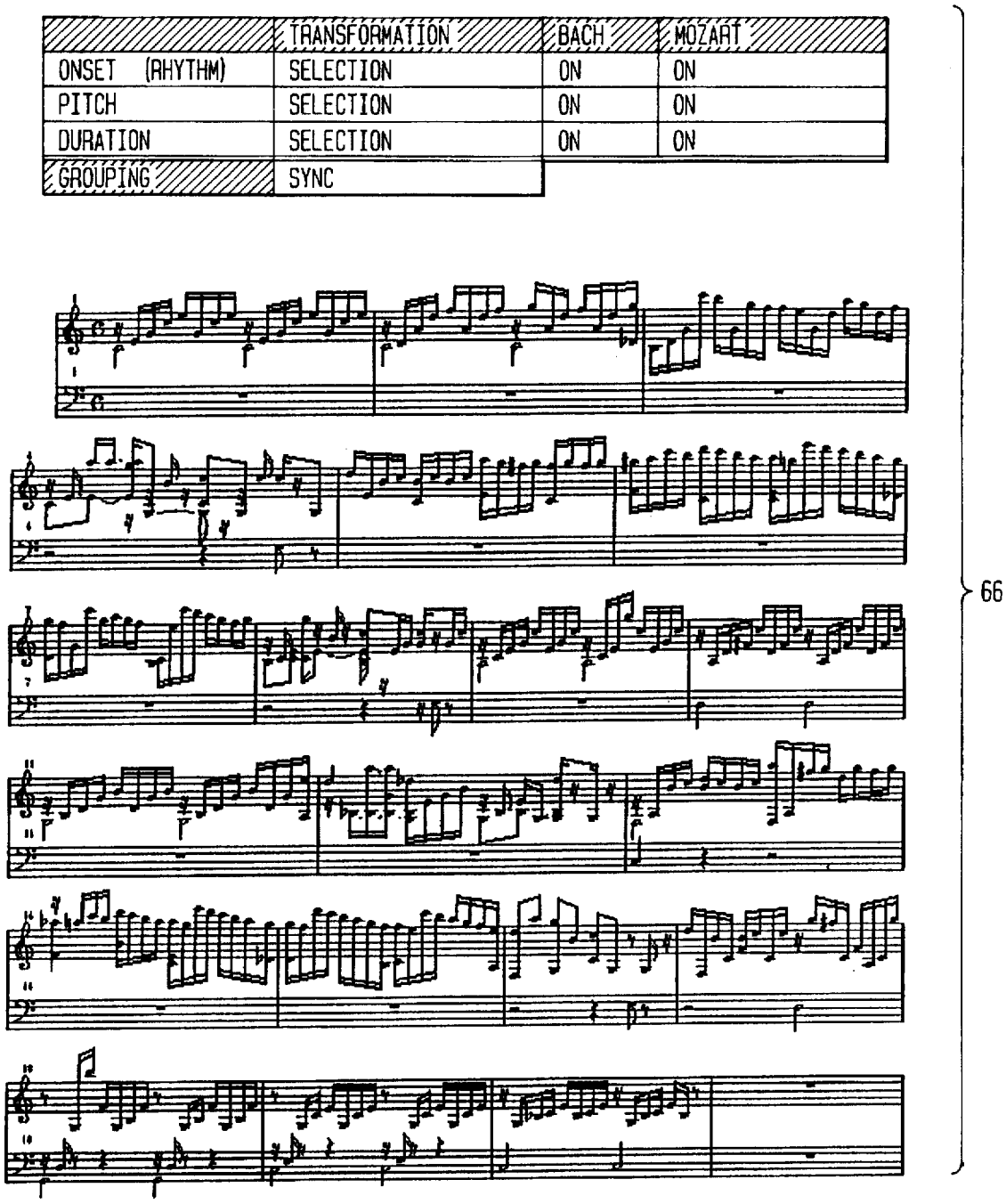
FIG. 29 shows a morphing of Bach into Mozart.

This embodiment is exemplified in FIG. 29, numeral 66.

As a final example we present a complete morph from the Bach Prelude into Mozart's first variation for piano from the A major Sonata (transposed to C major in this example). Bars 2–5 are a transition into Mozart, 7–8 are a transition into Bach, 11–13 a transition back to Mozart, and in measure 19 we arrive back to Bach.

Implementation: The DMorph System

Figure 30:
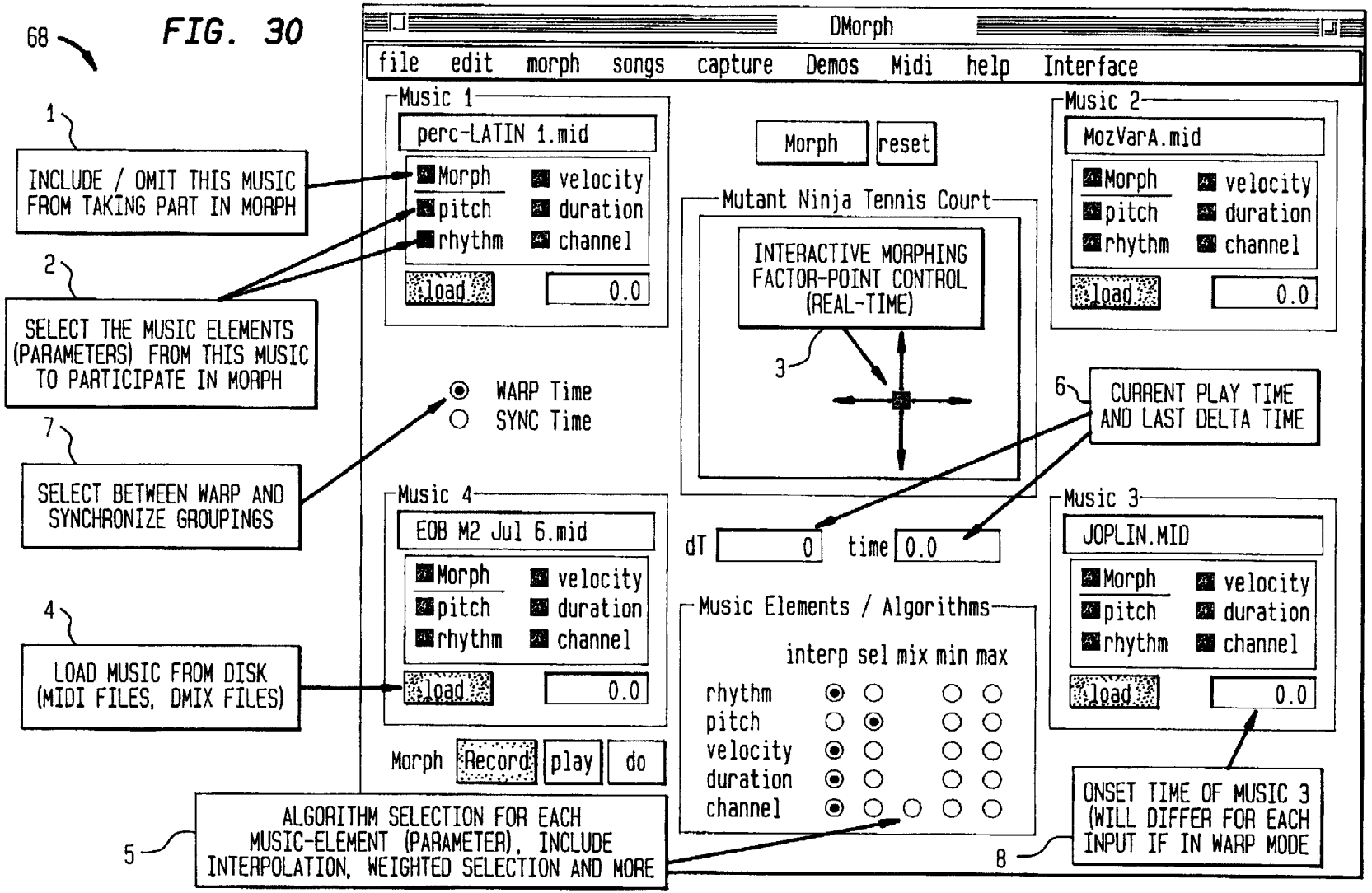
FIG. 30 shows the DMorph front end allowing simultaneous morphing of four musical events.

FIG. 30, numeral 68, shows one of the front ends that may be used for interactive morphing. In this implementation, up to four musical works can be used as inputs for a morphing process (Music1 through Music4). Music can be loaded from disk as a standard MIDI file (4, numbers refer to the figure), or Slapped in from anywhere within the Dmix environment (Oppenheim, D. 1993a). Each music input can be turned on or off individually (1), and the user can determine which of its parameters will participate in the morphing process (2). For each music element the user may select between several transformation functions, including linear and non linear interpolation, weighted selection, and mixing for Midi Channel (5). One of two grouping methods can be selected: Time Warped or Time Synchronized grouping (7). During playback the current time is displayed and last delta time get displayed (6), as well as the current time of each input event (8). Note that if Time Warped grouping is used then the current time of each music input may differ considerably.

The Factor point (3) may be controlled by Midi events allowing the morpher to be controlled in real time in a variety of ways, such as a dancer's location on a stage. The morpher can also be run in a non interactive mode if a morphing function is supplied. This can be done by Slapping a function onto DMorph. If, for example, the function in FIG. 19 is be slapped onto DMorph, then a morph will take place between input Music1 and Music2.

Calculating the Morph Factors

Figure 31:
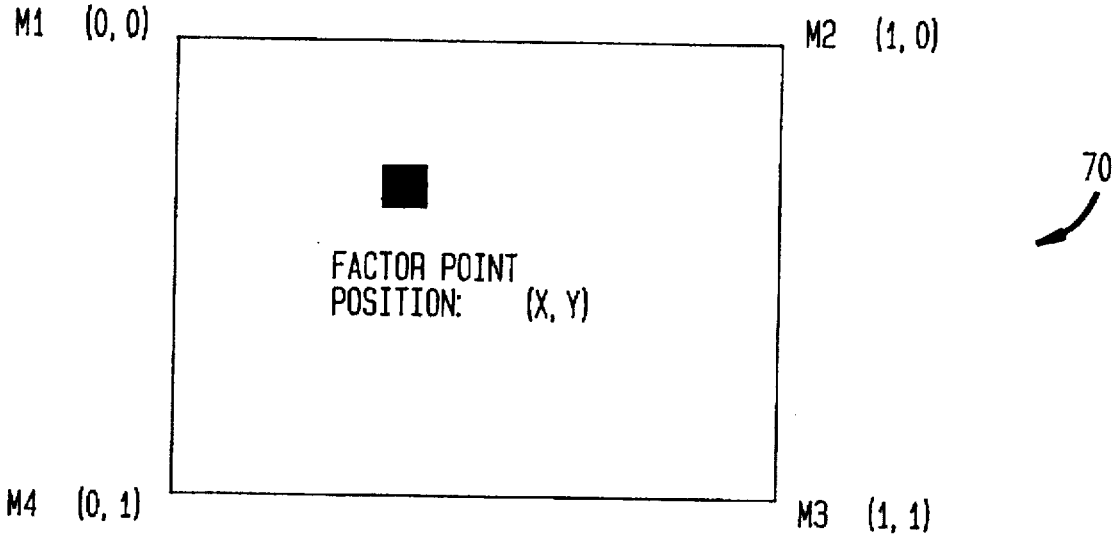
FIG. 31 shows the calculating of the morph factors.

Calculating the morph factor is exemplified by of FIG. 31, numeral 70.

The user interface used in DMorph allows the placement of up to four music inputs, M1 through M4. During the morphing process the position of the factor point determines the relative weight of each music input. The coordinate system in which the factor point can be moved is normalized between (0,0) and (1,1).

When the user places the factor point in a corner, then the music generated is identical to the music in that corner. As the user moves the Factor Point towards the center (0.5,0.5) the new music gets to be equally effected by all sources. When the user moves the point along a side, then only the two inputs that are connected to that side will take part in the morph. For example, if the user is moving from point (0,0), to (1,0), keeping the Y value at 0, then the result will be a morph between M1 and M2 with no influence from M3 or M4.

The calculation of each new value as a function of the Factor point's position is the following:

$$v = \left\{ \frac{\sum_{i=1}^{4} m_i w_i^k q_i}{\sum_{i=1}^{4} w_i^k q_i} \right\} \quad (1)$$

where $m_i$ is value from one of the four music inputs and $w_i$ is a Morph Factor (weight) for that value. $q_i$ is a function that returns a value of 1 if the input $m_i$ exists and 0 if not, thus each parameter from each input can be individually turned on or off:

$$q_i = \begin{bmatrix} 1 & \text{if } m_i \text{ is on} \\ 0 & \text{if } m_i \text{ is off} \end{bmatrix}$$

The exponential k of the weight $w_i^k$ determines how soon other inputs will begin to take effect as the Factor Point is moved out of a corner k is a positive number. As its value increases above 1 the user will have to move further away from the corner before the effect of other inputs will be noticed. The reverse is correct for values smaller than 1 (but always larger than 0).

The morph factor (weight) for each music is derived as follows:

$$w_1 = (1-f(x))(1-g(y))$$

$$w_2 = f(x)(1-g(y))$$

$$w_3 = f(x)g(y)$$

$$w_4 = (1-f(x))g(y)$$

where f(x) and g(y) are two functions that are be used to control the amount of effect of changing the x and y coordinates. They can be any function that follows the following three conditions:

f(0)=0 f(1)=1 f(k)>f(n) if k>n

The general weighting algorithm in equation (1) above can now be expanded to show how each weight is calculated:

$$v = \left\{ \begin{array}{l} m_1((1-f(x)(1-g(y))^k/C \\ +m_2(f(x)(1-g(y)))^k/C \\ +m_3(f(x)g(y))^k/C \\ +m_4((1-f(x))g(y))^k/C \end{array} \right\}$$

where C is a constant:

$$C = \sum_{i=1}^{4} q_i w_i^k$$

A simplification adopted in DMorph for f(x) and g(y) is to use two identical functions that are f(k)=k thus simplifying the formula for v to:

$$v = \left\{ \begin{array}{l} m_1((1-x)(1-y))^k/C \\ +m_2(x(1-y))^k/C \\ +m_3(xy)^k/C \\ +m_4((1-x)y)^k/C \end{array} \right\}$$

The formula above does an interpolation of the values $m_1$ through $m_4$ and returns a new value v. The same weights, $w_1/K$ through $w_4/K$ are used for obtaining a weighted selection.

Some advantages and limitations of this technique should be noted. The transformation is symmetric: at the center point the weight for each music input is identical; in the middle of a side both inputs that are connected to it also have an equal weight. Moving the Factor Point between the four inputs produces the desired result of a weighted mix. Moreover, moving the point along a side will morph only the two inputs at each end, ignore both others. All possible combinations are M1 and M2, M2 and M3, M3 and M4, M4 and M1. However, there is no way to single out inputs along diagonals, i.e., M1 and M3, M2 and M4. Moreover, there is no way to single out any three inputs and ignore the fourth, though this can be done by manually switching off the fourth input (see FIG. 30 (1)).

Separate Control Over Each Musical Aspect

Figure 32:
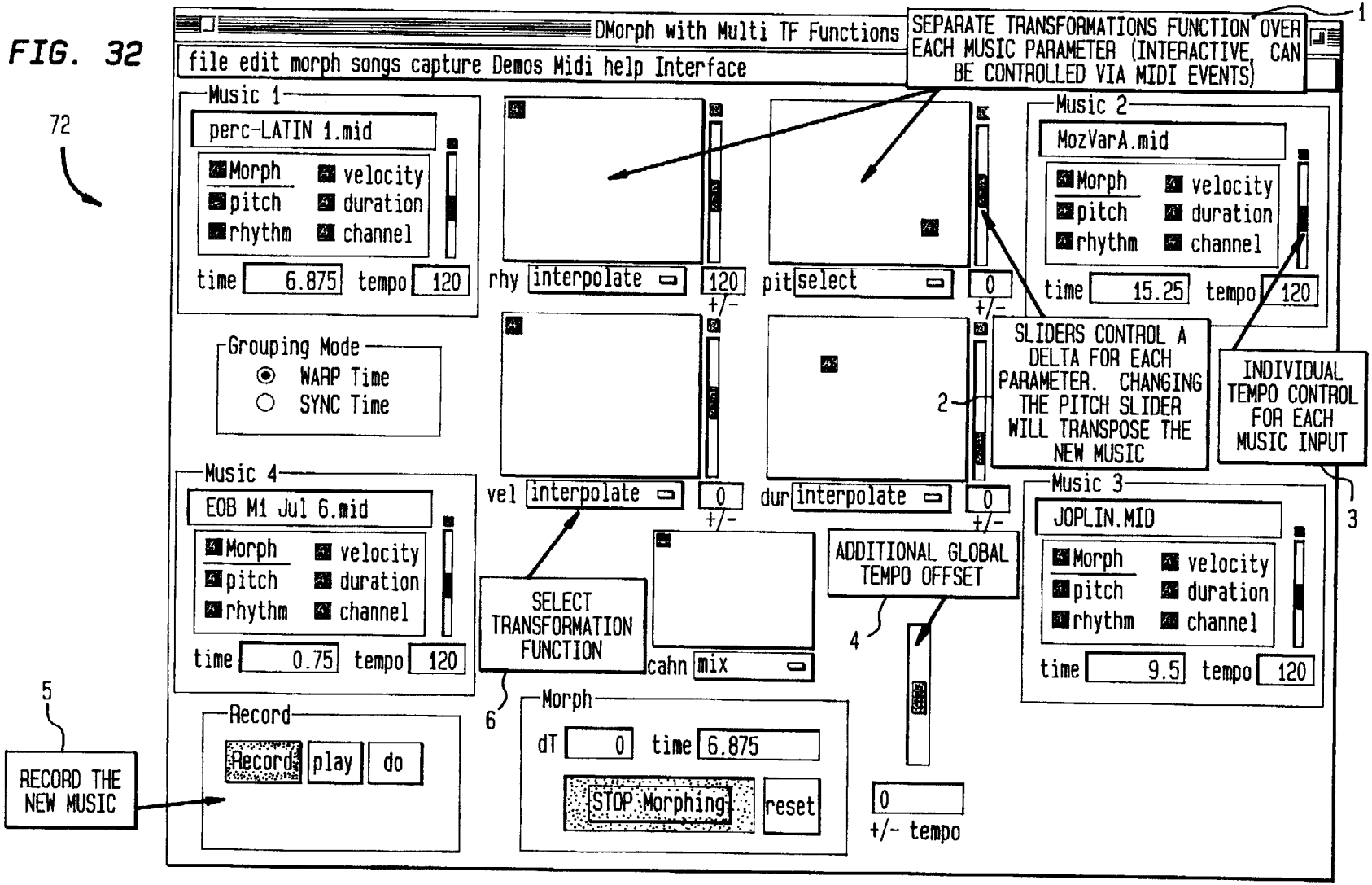
FIG. 32 shows using a different factor function for each music attribute.

FIG. 32, numeral 72, shows a more sophisticated front end to DMorph that allows the user to control each music element separately. In this implementation a separate Morph Factor Function is used for each music element and is set interactively by dragging its factor point on the display (1). In this example the resultant music has the rhythm of Latin percussion using pitches that are very close to Joplin's Maple Leaf Rag. By moving the Pitch Factor Point towards Music2 the pitches would gradually change to those from Mozart's variations, leaving all other music attributes unvaried. Moving the Pitch Factor Point towards Music 4 would mutate the pitches into those of Philip Glass's Einstein on the Beach.

Two other enhancements can be seen in this implementation. A slider enables the user to add offset that can be added to the value of each new parameter (2). Moving the pitch slider, for example (2) will cause the new music to transpose accordingly. In addition, a separate control over the tempo of each music input is provided (3). The tempo of the new music is calculated via a non linear interpolation using the tempo value from each input relative to the position of the Rhythm's Factor Point. If, for example, Music 1 had a tempo of 100 and Music 2 would have the tempo of 200, then the tempo of the new music would be 100 when the Rhythm factor point would be at the top left corner, and 200 when it would be set at the top right corner. An additional tempo offset slider will accordingly adjust the tempo of the new music (4).

The morphing session may be recorded (5) and the result can be edited or saved to disk as a MIDI file. Finally, the transformation function used for each music element can be selected via a menu (6).

A Morph View

Figure 33:
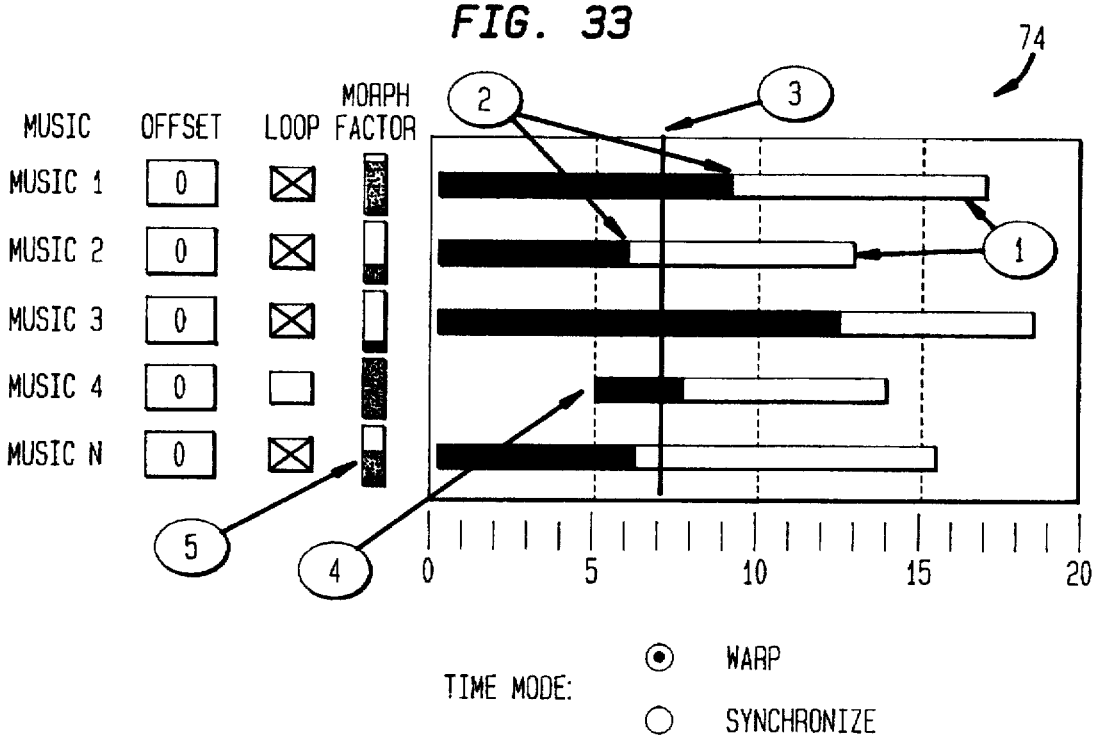
FIG. 33 shows a Morph View.

A morph view is illustrated in FIG. 33, numeral 74.

A different view, currently still under implementation, is the morph view. Here, each music input is represented by a bar graph. The length of the graph (1, see FIG. 33) represents the duration of that music. As the morphing process is running, a time-line (3) scrolls to show the onset times of new events. The black mark (2) represents the onset time of the source event that is currently grouped—since the grouping mode is set to WARP each input is at a different time. A small bar graph (5) shows the current morph factor for each source. Note that Music4 has a time offset of 5 units and begins in time 5 (4). This feature is useful especially in SYNC mode if one wants to morph musical characteristics that occur in different onsets, or morph a music with itself in canon.

Every music source can be in loop mode. If that is the case then when it finishes participating in the morph it will start again from its beginning. Otherwise, after its last event is read it removes itself from the morphing process.

Hardware System

Figure 34:
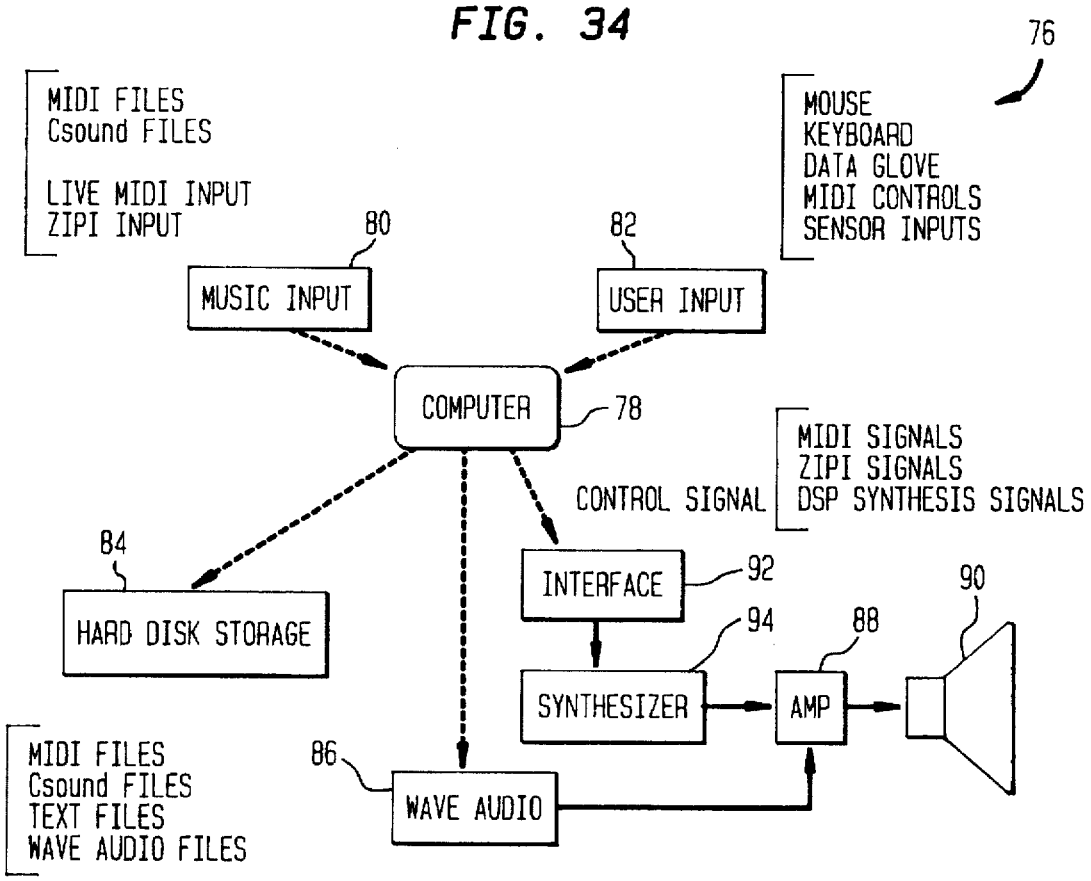
FIG. 34 shows a hardware system.

Attention is now directed to FIG. 34 which shows a preferred system 76 suitable for effecting music morphing in real time in accordance with the method of the present invention. The system 76 comprises a conventional computer 78, for example, an IBM Pentium 90 MHz. The computer 78 comprises a programmable memory for storing a program. The program preferably executes the steps of:

i) selecting a first sequence of musical events;

ii) identifying a family of first musical elements encompassed by said first musical sequence;

iii) selecting a second sequence of musical events;

iv) identifying a family of second musical elements encompassed by said second musical sequence;

for each new event that is to be generated v) creating at least one paired set comprising one element from each of the first and second sequences;

vi) associating each paired set to a parameter type in the new event;

and for each element of the paired sets vii) assigning a grouping function for selecting values from the musical elements;

viii) assigning a morphing factor for determining a relative weight of resemblance to each of said musical sequences; and ix) assigning a transformation function for mapping the selected values in accordance with a morphing factor for that set, thereby generating a value comprising one parameter of the new event.

Appendix A recites pseudo code that may be used to realize the steps of this program and may be written in Smalltalk.

The FIG. 34 system also includes a music input 80 to the computer 78. The music input 80 may include MIDI files, Csound files, Live MIDI or ZIPI input. (MIDI is an abbreviation for Musical Instrument Digital Interface, and ZIPI is a proposal for an improved interface standard).

The computer 78 further accepts user input 82, for example, mouse, keyboard, data glove, MIDI controls or sensor inputs, in a well known way.

The computer 78 can output, in a conventional way, hard disk storage 84 comprising MIDI files, Csound files, text files, or wave audio files; wave audio 86, for ultimate output to an amplifier 88 and a speaker 90; and, interface 92 comprising processing of control signals including e.g., MIDI, ZIPI, and DSP (Digital Signal Processing) synthesis signals. The interface 92, in turn, can output to a conventional synthesizer 94 for access to the amplifier 88 and to the speaker 90.

Appendix A: Implementation and Pseudo Code

Code Design Overview

The code is modeled closely on the model that is presented earlier (see FIG. 1 and FIG. 2). The implementation is based around two Smalltalk classes: MusicReader and Morpher. An instance of class MusicReader is assigned to handle each music input. It handles a ReadStream on the events of the music input, knows how to advance the stream to a given time onset, access the parameters of the current event, provide various facilities for calculating the morph-factor, and keep track of a set of flags that indicate what parameters are being morphed.

An instance of class Morpher models the morphing engine. It manages a collection of MusicReaders, manages the output stream for the new music, maintains the transformation functions and assigns them, manages the factor function or its equivalent when morphing is interactive, and performs a variety of bookkeeping chores.

Following is pseudo code that describes the basic API of these two objects. The actual code is somewhat more complex and uses several other classes, but does not differ in its basic design.

Class MusicReader

Instance Variables

<currentEvent> this is the event that will be used to calculate parameters for the next morph-event.

<currentOnset> the onset of the currentEvent.

<musicStream> the stream on the source music I am connected to. It reads the events (notes) and their time onset.

21 timeOffset> an offset that will be added to the onsets of new events. This way an input could be moved in time relative to other inputs, or a music could be morphed against itself in cannon.

<paramterFlags> a Dictionary for each parameter-type that holds a flag used to determine if that parameter will take part in the morph.

Remaining instance variables are private and are implementation independent.

Methods

Onset access peekOnset

Peek the time onset of the next event (note) in my musicStream. If (isLooping not) and (musicStream atEnd) then return nil. This should signal the requester, a morpher, that my music input has ended, and so has my role in the current morphing process.

currentOnset

Return the onset of the current event (note) I am referencing. This is the note from my musicStream has been grouped and will take part in determining the parameters of the next morph-event.

advanceToOnset: aDesiredOnset

Tricky. If I am in WARP mode, then I simply advance my musicStream to its next event.

If I am in SYNC mode, then I advance so long as the offset of my currentEvent will be <=aDesiredOnset.

NOTE that in some cases no change will occur, i.e., the current event will remain and take place again in the next morph cycle, and in some cases I may skip over several notes.

latestNoteOffOnset

This keeps track of the latest end-time of any note that my musicStream has read. This is needed to determine whether or not there is a rest in the currentOnset. An alternative would be to use rest-events in the music representation.

isResting

Answer true if lastestNoteOffOnset<currentOnset (or if my currentEvent isKindOf: RestEvent).

timeOffset: anOffset

Add anOffset to my onset. currentOnset will return the actual onset of the current event+anOffset. This feature is rarely used but handy if you want to time-Shift one music in relation to another. For example, the same music can morph against itself in canon.

time Offset"most always 0"

Return the current timeOffset. If not set it will be 0.

Event Parameter Access

Notes:

1. parameters in this example are MIDI specific. Other parameters would be available in a system that support other forms of synthesis, such as Csound or Music-Kit.
2. Each parameter is assigned a flag that is accessed by the transformation function. This enables the user to switch on an off any parameter from any individual music-Stream during a morphing process. It is useful, and very common, not to include all available parameters in the morphing process.
3. A more Generic implementation my use something like: isMorphing: #parameterSymbol pitch Return the pitch parameter of the current event.

isMorphingPitch

A flag the user may set to determine if the pitch parameter will take part in the morphing process. Stored in parameter-Dic.

duration

Return the duration parameter of the current event.

isMorphingDuration

A flag the user may set to determine if the duration parameter will take part in the morphing process. Stored in parameterDic.

velocity

Return the velocity parameter of the current event.

isMorphingVelocity

A flag the user may set to determine if the velocity parameter will take part in the morphing process. Stored in parameterDic.

channel

Return the channel number of the current event.

isMorphingChannel

A flag the user may set to determine if the channel parameter will take part in the morphing process. Stored in parameterDic.

isMorphing: #aParameterSymbol

A more general method that will adapt itself to events having any number of parameters.

Access for Morph Factor calculations morphFactor: aWeightingFactor

Store aWeightingFactor, the Morph-Factor that has been assigned to me that will be applied to the current note.

morphFactor

Return the current morph-factor.

distance: aDistance

Store aDistance. This is the distance from the graphic representation of my musicStream on the display from a factor-point that is manipulated by the user via some control device, such as a mouse, joy stick, or MIDI controller.

distance

Return aDistance. This will be used to calculated my Morph-Factor.

Music Source Stream access musicStream: aStreamOnAMusic

Attach me to a stream on some input music.

musicStream

Return the musicStream that I am connected to.

Flags isLooping

If true, when the musicStream reaches to the end it will reset and start at the beginning.

isMorphing

If false, my musicStream will not take part in the current morph. Depending on the implementation my stream will probably still advance, so that I stay synchronized with other music inputs and can be turned on at any time.

Class Morpher

Instance Variables

<musicReaders> an OrderedCollection of musicReaders. There will be one musicReader for each music that takes part in the morphing process. The number of readers is unlimited.

<outputStream> a stream into which the generated music is passed. This will most likely cause the events to play. Typically events will be saved in some internal format that can then be edited and saved on disk.

<musicElementTransformationFunctionsDic> a Dictionary that associates each music element type that is participating in the morphing process with a transformation Function. When the user selects a certain transformation function for a certain parameter it gets stored here.

<transformationFunctionLibrary> a library of user extendible transformation functions. When the user selects a specific transformation for a given parameter it is selected from this library. If a user defines a new transformation it gets saved in this library.

<currentTime> this is the onset-time for the event that is currently being calculated for the morph.

<factorFunction> This is an object that will return a Morphing-Factor as a function of the currentTime. This can be a Function or a ValueHolder. The ValueHolder will be connected to a user controlled device, such as a mouse, joy stick, or MIDI controller. It will ignore the currentTime and simply return a value that corresponds to the current position of the Control device.

<noteEvent> an efficiency hack. Every time a new morph-note is to be generated, the parameters are fed into the noteEvent. A copy of the noteEvent is finally made and either played or saved. This way parameters that do not take place in the morph always get default values. This also enables the user to change the parameters that participate in the morph on the fly without breaking the system-parameters stick to their last set values.

Methods

Morphing run

Begin morphing. If pausing then resume, otherwise create a morphing process and schedule it.

pause

Pause the morphing process. This can be resumed if run.

stop

Stop morphing. Terminate the morphing process.

reset

Stop morphing. Rest all stream to their beginning.

Selecting Transformation Functions userSelectTrasformFunctionFor: aParameter allow the user to select a transformation function for aParameter. Functions are stored in the transformationFunctionLibrary.

Moprhing Process/Algorithm scheduleMorphProcess

This is the heart of the morph. The following steps outline the algorithm.

WHILE MORPHING DO (i.e., to generate each new note):

1. Determine the morphing factor for each parameter.

If a morphing function is used this factor is obtained directly by providing it the currentTime as an argument.

If morphing is interactive then:

a. Measure the distance of each musicReader from the position of the factor point. This point is moved by some input device (mouse, joy stick, etc.).

b. Calculate the morph factor for each reader as a function of its distance from the factor point and pass this value to the musicReader.

2. Determine the next onsetTime.

a. Scan each musicReader and collect its next onsetTime.

b. Determine next onset with the onset-transformation-function. Note that a different onset will be returned if in WARP or SYNC modes.

3. Advance all musicReaders to the next onsetTime. Depending on the type of time-handling used this may have different effects. If a WARP method is used (Time-Warping), then all streams will advance to the next event. If an SYNC method is used, some streams may remain unchanged while others may advance and skip over several events.

4. Group all next source events.

5. For each parameter that is participating in the morphing process:

a. Collect from the grouped events their current parameter value and parameterFlag.

b. Pass this collection to the appropriate transformation function with the corresponding MorphFactor for that parameter.

c. Feed the value returned from the transformation function into the noteEvent.

6. Play the noteEvent, i.e., pass it out to the outputStream.

7. If recording, copy the noteEvent and store it in the recording with its onset time.

What is claimed:

1. A method for effecting musical morphing in real time, the method comprising the steps of:

1) selecting a first sequence of musical events;

2) identifying a family of first musical elements encompassed by said first musical sequence;

3) selecting a second sequence of musical events;

4) identifying a family of second musical elements encompassed by said second musical sequence;

for each new event that is to be generated 5) creating at least one paired set comprising one musical element from each of the first and second sequences;

6) associating each paired set to a parameter type in the new event;

and for each element of the paired sets 7) assigning a grouping function for selecting values from the musical elements;

8) assigning a morphing factor for determining a relative weight of resemblance to each of said musical sequences;

and 9) assigning a transformation function for mapping the selected values in accordance with a morphing factor for that set, thereby generating a value comprising one parameter of the new event.

2. A method according to claim 1, wherein a sequence of events comprises a musical composition.

3. A method according to claim 1, wherein a sequence of events is generated by an external source.

4. A method according to claim 1, wherein a sequence of events comprises a sequence of musical notes.

5. A method according to claim 1, wherein a family of musical elements comprises at least one of rhythm and pitch.

6. A method according to claim 1, wherein a family of musical elements comprises at least one of rhythm, pitch, loudness, timbre, duration, and vibrato.

7. A method according to claim 5, wherein step 5) comprises creating a paired set comprising first musical sequence rhythm and a second musical sequence rhythm.

8. A method according to claim 5, wherein step 5) comprises creating a paired set comprising a first musical sequence pitch and a second musical sequence rhythm.

9. A method according to claim 1, wherein step 7) comprises selecting one value from each musical element.

10. A method according to claim 1, wherein step 7) comprises selecting no value from the first musical sequence and several values from the second musical sequence.

11. A method according to claim 1, comprising assigning a relative weight of 0 to the first musical sequence.

12. A method according to claim 1, wherein a transformation function selects a value according to the relative weight determined by the morphing factor.

13. A method according to claim 1, wherein the transformation function maps a new value according to the value from the first musical sequence multiplied by the relative weight provided by the morph factor, added to the value from the second musical sequence multiplied by the second relative weight provided by the morph factor, divided by the sum of their weights.

14. A method according to claim 1, wherein step 8 comprises assigning the same morphing factor to each element of the paired sets.

15. A method according to claim 1, wherein step 8 comprises assigning a different morphing factor to each element of the paired sets.

16. A method according to claim 1, wherein step 9 comprises assigning the same transformation function to each element of the paired sets.

17. A method according to claim 1, wherein step 9 comprises assigning a different transformation function to each element of the paired sets.

18. A method according to claim 1, wherein the first musical sequence comprises an output from an independent computer system that is generating music in real time.

19. A method according to claim 1, comprising implementing the steps in a computer.

20. A method according to claim 1, comprising storing the steps in a storage device readable by a computer.

21. A system suitable for effecting musical morphing in real time, the system comprising:

1) a computer comprising a programmable memory for storing a program comprising the steps of:

i) selecting a first musical sequence of events;

ii) identifying a family of first musical elements encompassed by said first musical sequence;

iii) selecting a second musical sequence of events;

iv) identifying a family of second musical elements encompassed by said second musical sequence;

for each new event that is to be generated v) creating at least one paired set comprising one element from each of the first and second musical sequences;

vi) associating each paired set to a parameter type in the new event;

and for each element of the paired sets vii) assigning a grouping function for selecting values from the musical elements;

viii) assigning a morphing factor for determining a relative weight of resemblance to each of said musical sequences;

and ix) assigning a transformation function for mapping the selected values in accordance with a morphing factor for that set, thereby generating a value comprising one parameter of the new event;

2) a means for converting the new event into a control signal;

and 3) a synthesizer for inputting the control signal and outputting a sound signal.

22. A system according to claim 21, further comprising means for amplifying the sound signal.

23. A system according to claim 22, further comprising a speaker for realizing the sound signal.

24. A system according to claim 21, further comprising input means to the computer.

* * * * *